US006808314B2

(12) United States Patent
Yamada et al.

(10) Patent No.: US 6,808,314 B2
(45) Date of Patent: Oct. 26, 2004

(54) OPTICAL FIBER END FACE POLISHING MACHINE

(75) Inventors: Kunio Yamada, Chiba (JP); Takehiko Narita, Chiba (JP); Yoshitaka Kimura, Chiba (JP); Yuichi Arai, Chiba (JP)

(73) Assignee: Seikoh Giken Co. Ltd. (JP)

( * ) Notice: Subject to any disclaimer, the term of this patent is extended or adjusted under 35 U.S.C. 154(b) by 70 days.

(21) Appl. No.: 10/216,852

(22) Filed: Aug. 13, 2002

(65) Prior Publication Data

US 2003/0036342 A1 Feb. 20, 2003

(30) Foreign Application Priority Data

Aug. 16, 2001 (JP) ..... P2001-247383

(51) Int. Cl.[7] ..... G02B 6/36; B24B 7/00
(52) U.S. Cl. ..... 385/85; 385/134; 451/271
(58) Field of Search ..... 451/271; 385/85, 385/134

(56) References Cited

U.S. PATENT DOCUMENTS 4,693,035 A 9/1987 Doyle
4,979,334 A 12/1990 Takahashi
5,048,929 A * 9/1991 Watanabe et al. ..... 359/896
5,720,653 A 2/1998 Miller et al.
6,077,154 A * 6/2000 Takashi et al. ..... 451/271
6,190,239 B1 2/2001 Buzzetti
6,280,293 B1 * 8/2001 Minami et al. ..... 451/10

FOREIGN PATENT DOCUMENTS

CN 2319171 Y 5/1999
EP 1 092 502 4/2001

OTHER PUBLICATIONS

Chinese Official Action and English Translation, dated Dec. 5, 2003.
European Search Report, dated Jan. 1, 2004.

* cited by examiner

*Primary Examiner*—Edward J. Glick
*Assistant Examiner*—Krystyna Suchecki
(74) *Attorney, Agent, or Firm*—Blank Rome LLP

(57) ABSTRACT

The center of a turntable 30 moves around the central axial line of an autoroation disk 20 along the circular orbit C of a smaller diameter than that of an autorotation disk 20. Thus, the turntable 30 revolves both around a center point O and on its own axis in accordance with an autorotation of the autorotation disk 20. A polishing holder 60 holds a connector of an optical fiber polished by a polishing film 41 arranged on the upper plane of the turntable 30. An optical fiber end face polishing machine provided with a memory 85 for storing a control program which allows a control device 80 to execute predetermined polishing steps, the control device 80 being for controlling an autorotation motor 16 of the turntable 30 and a revolution motor 14 thereof.

5 Claims, 21 Drawing Sheets

OPTICAL FIBER END FACE POLISHING MACHINE

BACKGROUND OF THE INVENTION

1. Field of the Invention

The present invention relates to an optical fiber end face polishing machine which polishes a connection end face of an optical connector used for, for example, an optical communication.

2. Description of the Related Art

Optical connectors have been used to connect optical fibers used for an optical communication. The optical fibers used for the optical communication are allowed to pass through the central holes of ferrules, and fixed to each other with adhesives. Then, end faces of them are polished for the respective ferrules to be mirror-finished. Polishing procedures for polishing the connection end face of such optical connector proceed over several polishing steps by use of polishing films ranging from coarse abrasive coating to fine abrasive coating, and the connection end face is mirror-finished finally. In the polishing steps, various processing conditions including sorts of used polishing films, selections of polishing liquid, polishing times and the like must be set.

For the polishing of the connection end face of the optical connector, there are four kinds including polishing for finishing an end face perpendicular to the axial line of the optical fiber to a flat plane, polishing for finishing an end face perpendicular to the axial line thereof to a curved plane, polishing for finishing an end face slanted to a plane, which is perpendicular to the axial line thereof, to a flat plane, and polishing for finishing the end face slanted to the plane, which is perpendicular the axial line thereof, to a curved plane. The processing conditions in the polishing steps differ depending on the kinds of the polishing. Moreover, the processing conditions therein differ also depending on the shape and material of the ferrule.

The optical fiber end face polishing machine capable of polishing a large number of optical connectors at one time has been already developed, and used widely while meeting with acceptance.

SUMMARY OF THE INVENTION

However, though the related optical fiber end face polishing machine described above has a great advantage that this polishing machine is capable of polishing many optical connectors at one time, an operator is obliged to set the processing conditions for each of the polishing steps. Therefore, the operator is required to have many kinds of knowledge and skills, and he/she must set the processing conditions every time when the polishing procedure advances to a subsequent step. For this reason, the skillful operator cannot leave from the polishing operation by use of the optical fiber end face polishing machine, and is bound by the polishing operation. Moreover, there has been a problem that other operators cannot conduct the polishing operation by use of the optical fiber end face polishing machine when the skillful operator is incapable of engaging in the polishing operation.

An object of the present invention is to remove the foregoing problems, and to provide an optical fiber end face polishing machine which is capable of polishing a large number of optical connectors at one time, and which is capable of conducting desired polishing procedures according to instructions from programs by setting processing conditions of various polishing steps in the programs and by calling out an arbitrary program, whereby anyone can conduct the polishing operation simply and properly.

The optical fiber end face polishing machine solves the foregoing subjects, a first aspect of the optical fiber end face polishing machine of the present invention is provided with a turntable which moves its center along a circular orbit of a smaller diameter than that of an autorotation disk having a central axial line as its center, thus revolving both around the central axial line of the atutorotation disk and on its axis in accordance with an autorotation of the autorotation disk; a holding member for holding an optical fiber to be polished by a polishing film disposed on an upper plane of the turntable; a control device for controlling autorotation and revolution motors of the turntable; and a memory for storing a control program which allows the control device to execute previously determined polishing procedures.

A second aspect of the optical fiber end face polishing machine of the present invention is provided with a turntable which moves its center along a circular orbit of a smaller diameter than that of an autorotation disk having a central axial line as its center, thus revolving both around the central axial line of the atutorotation disk and on its own axis in accordance with an autorotation of the autorotation disk; a holding member for holding an optical fiber to be polished by a polishing film disposed on an upper plane of the turntable; a control device for controlling autorotation and revolution motors of the turntable; a touch panel for operating the control device; and a memory for storing a plurality of control programs which allow the control device to execute previously determined polishing steps, wherein when an operator manipulates the touch panel to select a desired control program among the plurality of control programs stored in the memory, the control device calls out the selected control program and allows the autorotation motor and the revolution motor to operate in accordance with the selected control program.

In addition to the second aspect, a third aspect of the present invention is an optical fiber end face polishing machine in which when the operates manipulates the touch panel to input data necessary for the control program, the control device stores the control program determined by the input data in the memory.

In addition to the second aspect a fourth aspect of the present invention is an optical fiber end face polishing machine, in which during executions of the polishing steps, the control device allows the touch panel to display states of portions of the machine including operation states of the autorotation and revolution motors.

DESCRIPTION OF THE PREFERRED EMBODIMENT

An embodiment of the present invention will be described with reference to the accompanying drawings below.

Figure 1:
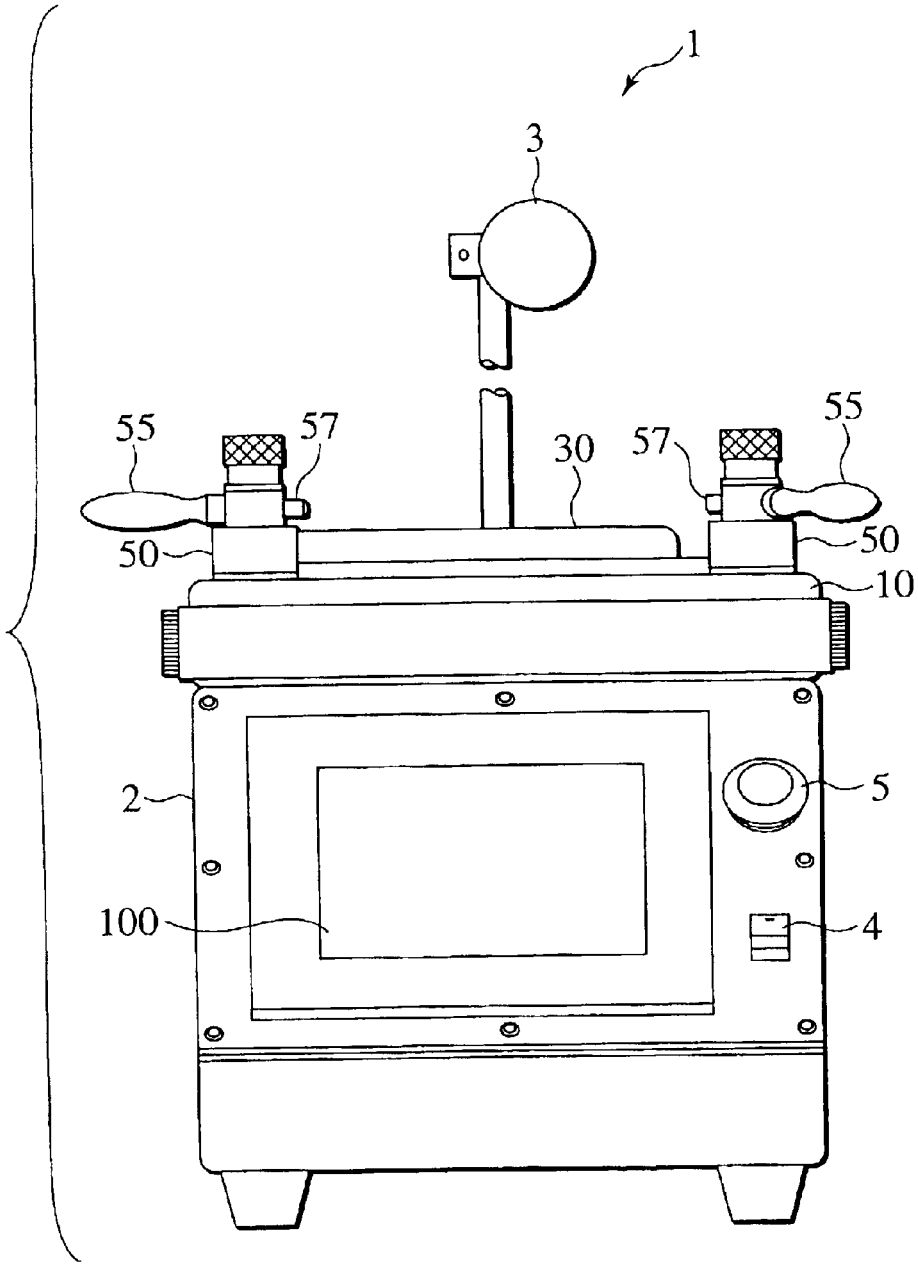
FIG. 1 is a front view illustrating one embodiment of an optical fiber end face polishing machine.
Figure 2:
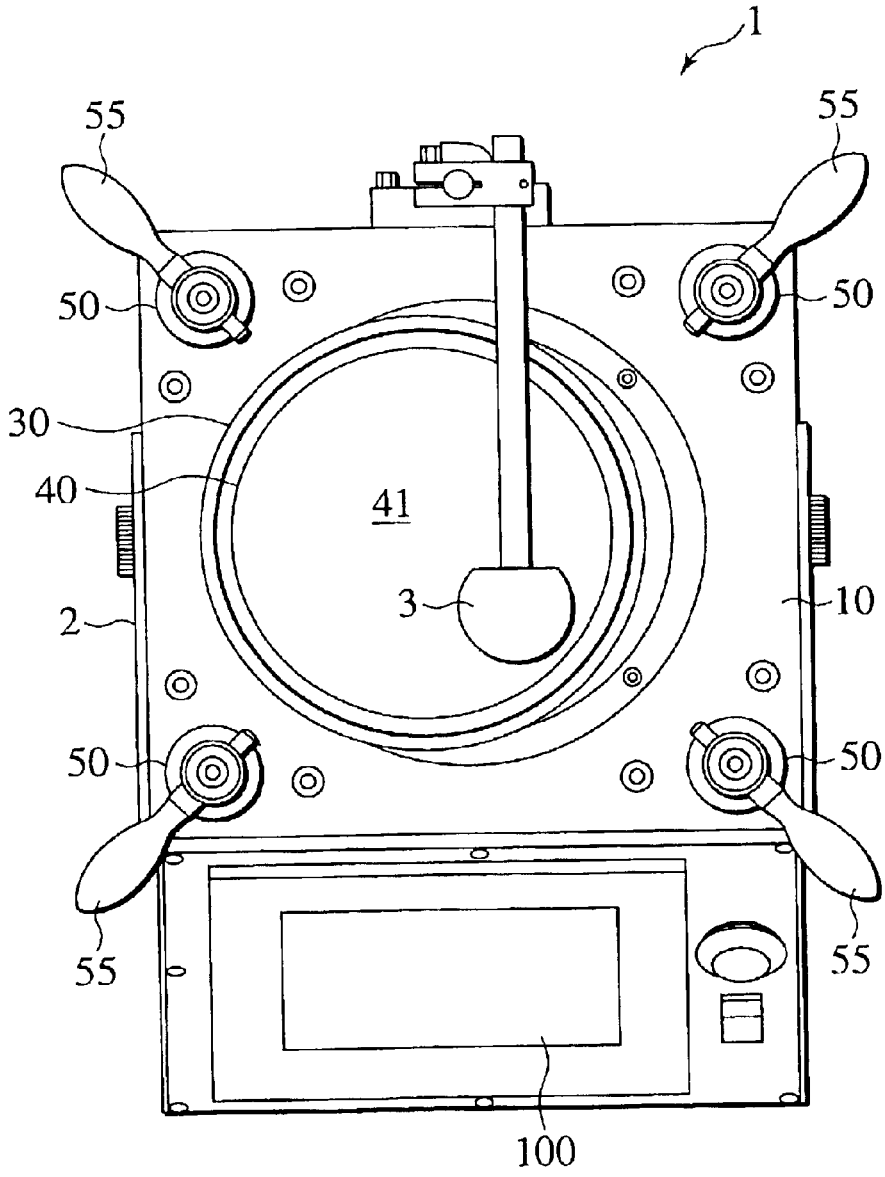
FIG. 2 is a plan view of the optical fiber end face polishing machine illustrated in FIG. 1.

FIG. 1 is a front view illustrating an embodiment of an optical fiber end face polishing machine according to the present invention. FIG. 2 is a plan view of the optical fiber end face polishing machine of FIG. 1. This optical fiber end face polishing machine 1 is provided with a turntable 30 located on the center of a square-shaped base 10 positioned on the upper plane of a box 2, the turntable 30 revolving both on its axis and around the center of the base 10 while keeping its horizontal posture; and a polishing pad 10 and a polishing film 41 are mounted on a horizontal upper plane of the turntable 30.

Figure 3:
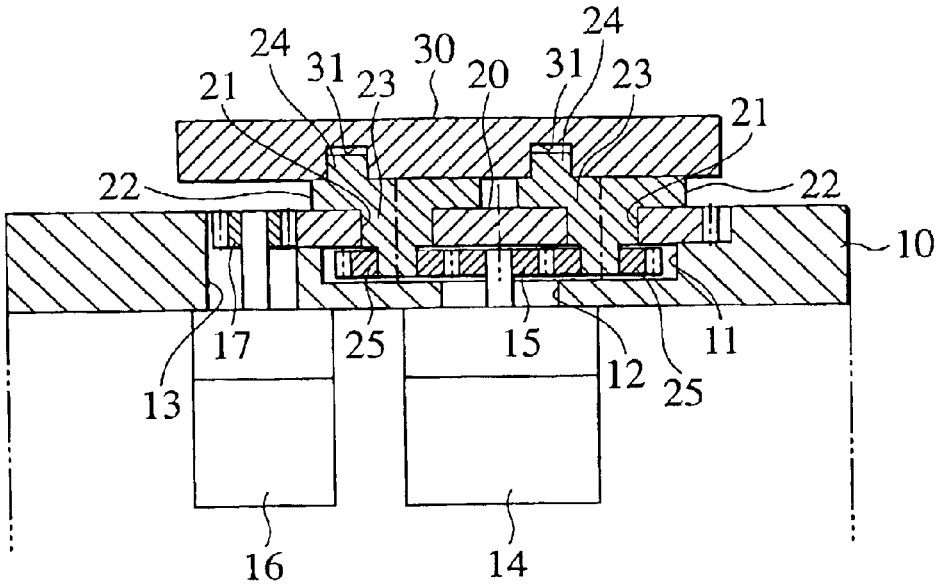
FIG. 3 is a longitudinal section view of a principal part illustrating a driving mechanism of a turntable.
Figure 4:
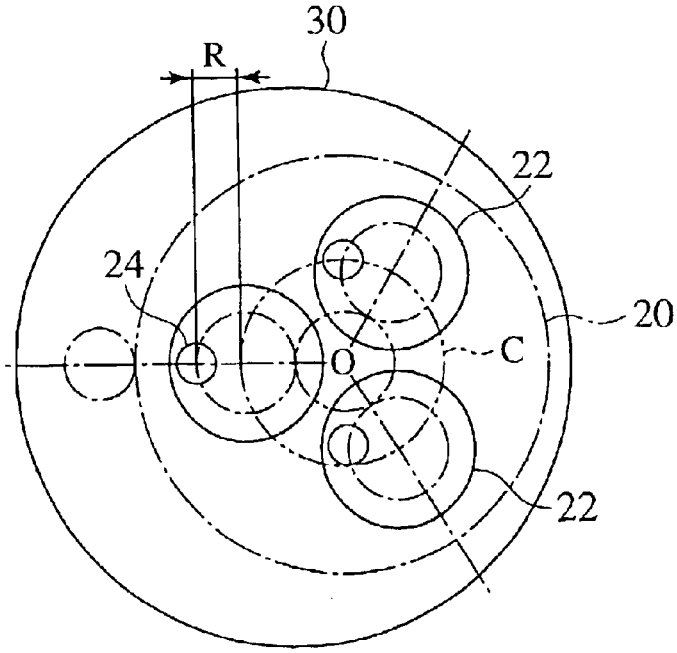
FIG. 4 is a schematic plan view illustrating the principal part of the driving mechanism of FIG. 3.

FIG. 3 is a longitudinal section view of a principal part illustrating a driving mechanism of the turntable 30, and FIG. 4 is a schematic plan view corresponding to the principal part illustrated in FIG. 3. A two-stage cylindrical back-facing hole 11 is provided approximately in the center of the base 10, and a through hole 12 is formed in the center of a seat portion of the hole 11. Moreover, a small diameter through hole 13 is formed in the base 10 so that a part of the hole 13 overlaps the external periphery of the two-stage cylindrical back-facing hole 11. A revolution motor 14 is attached to the lower plane of the base 10. A driving shaft of the revolution motor 14 penetrates through the through hole 12 to extend to a lower upper stage of the two-stage cylindrical back-facing hole 11 and is located at the center of the lower stage thereof. A driving gear wheel 15 is fixed to an end of the driving shaft of the motor 14. Furthermore, an autorotation motor 16 is attached to the lower plane of the base 10, and a driving shaft of the autorotation motor 16 penetrates through the through hole 13 to the uppermost portion of the two-stage cylindrical back-facing hole 11. A driving gear wheel 17 is fixed to an end of the driving shaft of the motor 16.

In the upper stage of the two-stage cylindrical back-facing hole 11, an autorotation disk 20 that is a disk-shaped gear wheel, which has an external peripheral gear engaged with the driving gear wheel 17 of the autorotation motor 16, is inserted supportably so that the autorotation disk 20 rotates around a central axis of the driving shaft of the revolution motor 14. In the autorotation disk 20, three through holes 21 are formed on a concentric circle around the center of the disk 20 at equal intervals in the circumference direction of the concentric circle. In each through hole 21, an axial portion 23 positioned at a lower center of an eccentric disk 22 is supportably inserted. An eccentric shaft 24 eccentric from the center of each eccentric disk 22 by a distance R is provided in an upper portion thereof and a planetary gear wheel 25 engaged with the driving gear wheel 15 of the revolution motor 14 is fixed to the lower most portion of the shaft of each eccentric disk 22.

On the other hand, in the under plane of the turntable 30, three acceptance holes 31 for rotatively accepting an eccentric shaft 24 of each of the three eccentric disks 22 are formed on a concentric circle around the center of the turn table 30.

With the above described constitution, when the revolution motor 14 is driven rotatively, the driving gear wheel 15 rotates, and the three planetary gear wheels 25 engaged with the driving gear wheel 15 rotates simultaneously with the wheel 15. Thus, each of the three eccentric disks 22 rotates around the central axial line of the axial portion 23. The eccentric shaft 24 of each eccentric disk 22 rotates around the central axial line of the shaft portion 23. Accordingly, the center of the turntable 30 in which the eccentric shafts 24 are rotatively accepted in the three respective acceptance holes 31 moves along the circular orbit C. The radius of the circular orbit C is equal to a distance from the center O, which is the rotation axial line of the revolution motor 14 (the central axial line of the driving gear wheel 15), to the rotation axial line of the eccentric disk 22 (the central axial line of the planetary gear wheel 25). Thus, the turntable 30 revolves around the center O.

Moreover, when the autorotation motor 16 is rotatively driven, the driving gear wheel 17 rotates, and the autorotation disk 20 engaged with the driving gear wheel 17 rotates around the rotation axial line of the revolution motor 14 (the central axial line of the driving gear wheel 15). After all, since the rotation axial line of the autorotation disk 20 is coincident with the revolution axial line of the turntable 30, the turntable 30 rotates around the rotation axial line of the autorotation disk 20 (the revolution axial line of the turntable 30), and, accompanied with the rotation of the autorotation disk 20, the revolution axial line itself of the turntable 30 rotates around the rotation axial line of the autorotation disk 20. Thus, the turntable 30 also revolves on its own axis.

Specifically, by allowing the revolution motor 14 and the autorotation motor 16 to be rotatively driven, the turntable 30 revolves both on the rotation axial line of the autorotation disk 20 as its own autorotation axis and around the rotation axial line thereof as its own revolution axis. Note that the rotation axial line of the autorotation disk 20 is coincident with the rotation axial line of the revolution motor 14.

Figure 5:
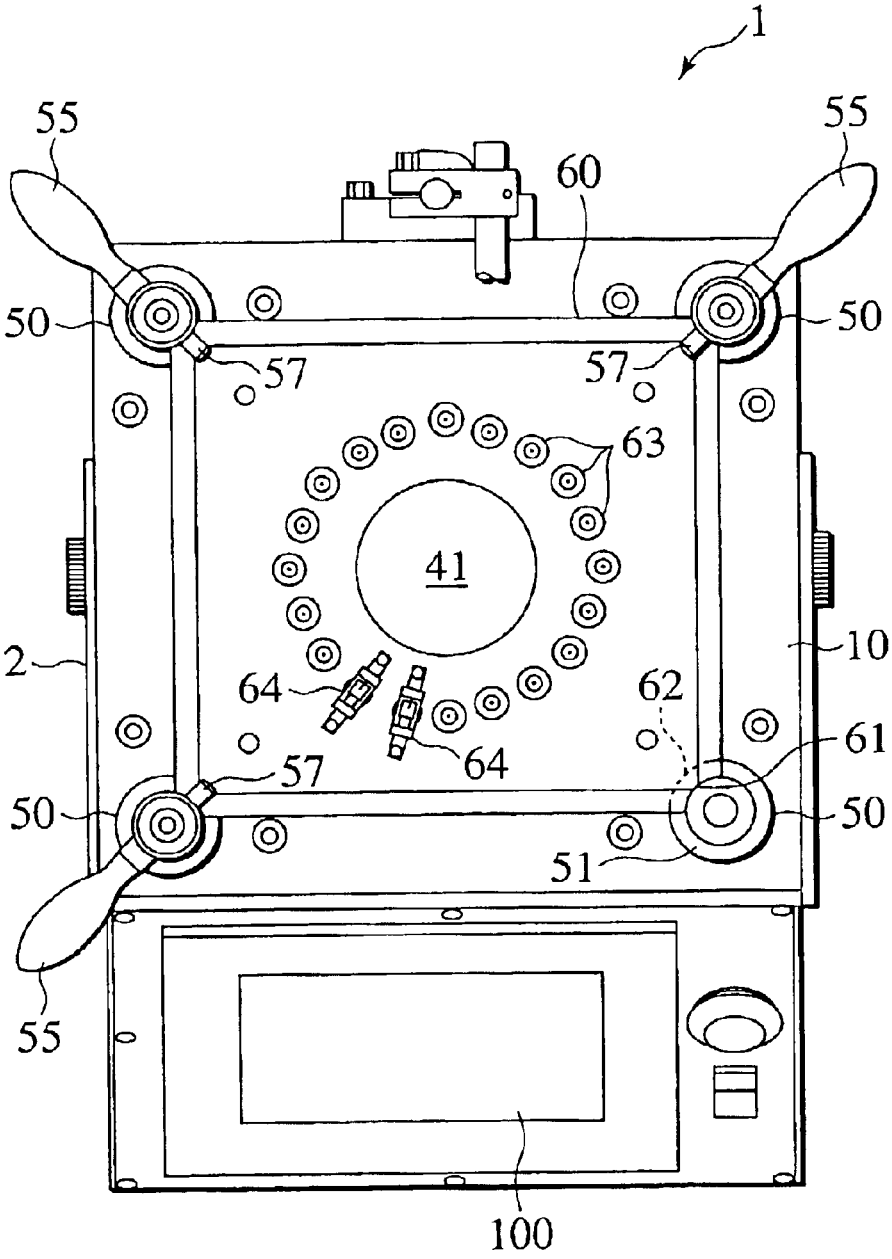
FIG. 5 is a plan view showing a state where a polishing holder is attached to the optical fiber end face polishing machine.
Figure 6:
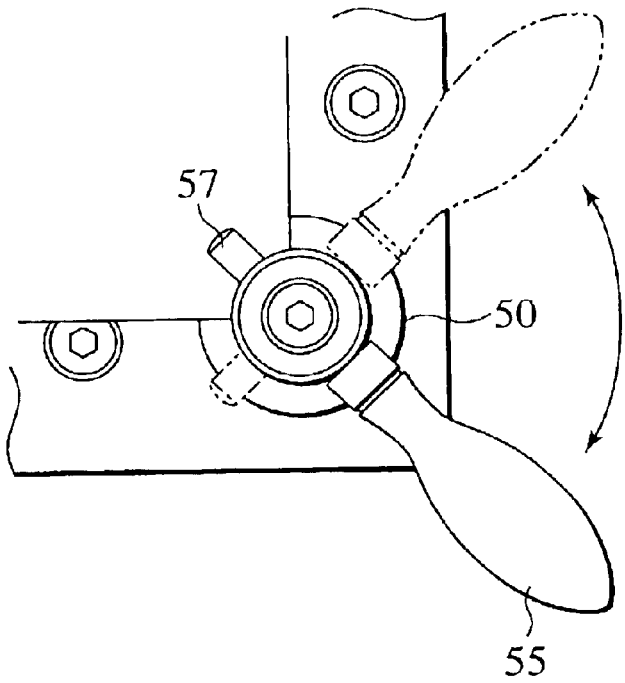
FIG. 6 is a plan view of a principal part showing an appearance of the attachment of the polishing holder to the optical fiber end face polishing machine.
Figure 7:
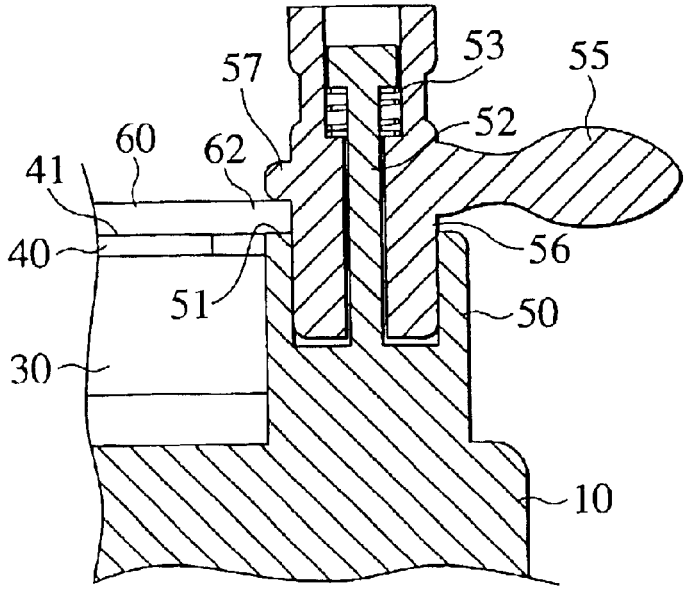
FIG. 7 is a longitudinal section view of the principal part thereof shown in FIG. 6.

As shown in FIGS. 1 and 2, four posts 50 are provided at the four corners of the base 10, and a pressurization lever 55 is fitted to each post 50, FIG. 5 is a plan view illustrating a state where a polishing holder 60 is fitted to the optical fiber end face polishing machine 1. As to the pressuring lever 55 located at the lower right of FIG. 5, which is not shown actually, the state where the polishing holder 60 is fitted to the pressurizing lever 55 is illustrated in the plan view of FIG. 6 and the longitudinal section view of FIG. 7. Specifically, in the polishing holder 60, a notched portion 61 (illustrated by one in FIG. 5) is formed at each of the four corners of a rectangular plate body, and the size of the notched portion 61 is determined so that the arc-shaped periphery 62 of the notched portion 61 is just placed on the cylindrical top 51 of each of the four posts 50. Moreover, each pressurizing lever 55 is fitted to the post 50 so that its barrel portion 56 inserts the shaft portion 52 of the post 50 and is compressed downward by the pressurizing spring 53. By turning the lever by hands, the direction of the pressurizing pin 57 can be changed. Therefore, when the polishing holder 60 is fitted, the four pressurizing levers 55 are previously turned so that all of the pressurizing pins 57 are directed outward (the state illustrated by dotted lines in FIG. 6), and the arc-shaped periphery 62 of the notched portion 61 is placed on the cylindrical top portion 51 of each of the four posts 50 at each of the four corners. Each of the pressurizing levers 55 is turned while pulling up the lever, the pressurizing lever 55 is set so that the pressurizing pin 57 thereof pushes each of the four corners of the polishing holder 60 from above (state illustrated by solid lines in FIG. 6).

Figure 8:
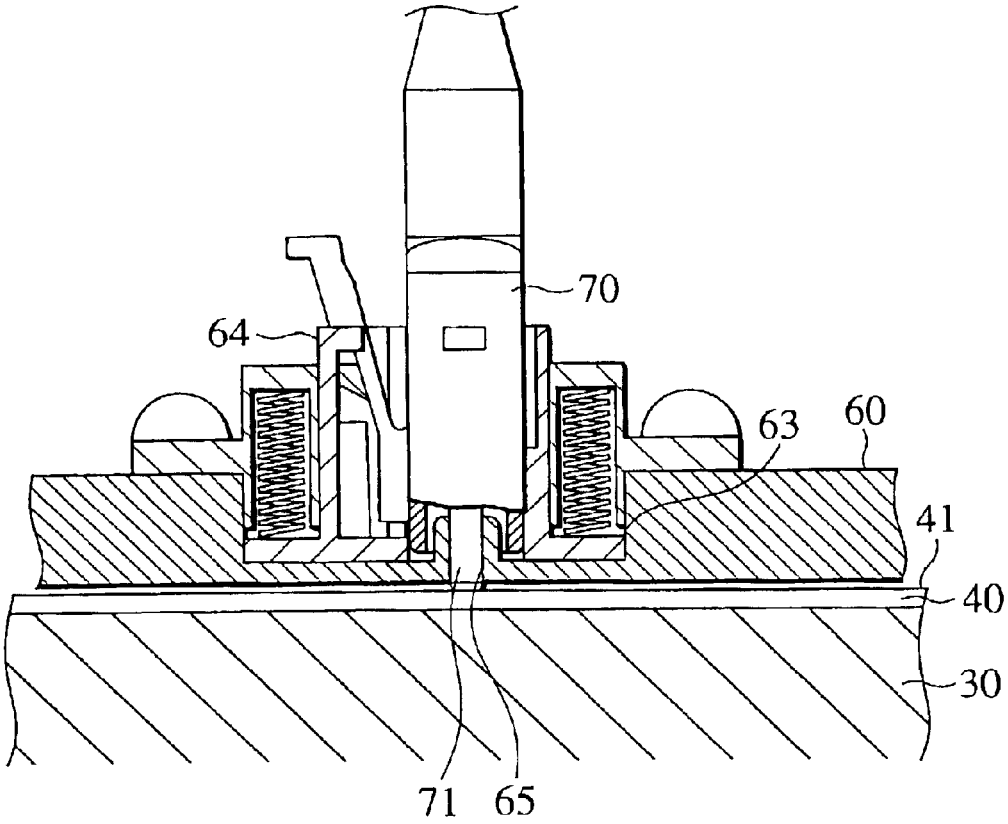
FIG. 8 is an enlarged section view of an adapter loading an optical connector.

In the polishing holder 60, a large number of loading portions 63 (20 pieces in the drawing) are arranged annularly around a circular hole formed at the center of the polishing holder 60, and an adapter 64 (only the two holders are illustrated in the drawing) on which an optical connector 70 (see FIG. 8) is loaded is fitted to each loading portion 63. FIG. 8 is an enlarged section view of the adapter 64 showing the state where the adapter 64 loads the optical connector 70. The adapter 64 is adjusted so that when the optical connector 70 is loaded on the adapter 64, a ferrule 71 of the optical connector 70 is inserted in a through hole 65 and penetrates therethrough, the through hole 65 being formed at the center of the loading portion 63 of the polishing holder 60, and the ferrule 71 protrudes from a lower plane of the polishing holder 60 by a predetermined amount, for example, 0.5 mm or more. The height of each post 50 is regulated so that when the polishing holder 60 in which the optical connector 70 is loaded on the adapter 64 is positioned for each of the four posts 50 to be fixed thereto by manipulating the pressurizing lever 55 as described above, the tip of the ferrule 71 protruding from the lower plane of the polishing holder 60 is pushed into a polishing film 41 by a predetermined amount, for example, 0.1 mm.

As shown in FIGS. 1 and 2, a cable holder 3 for hanging a cable of the optical connector 70 is provided in the box 2 so that when the polishing holder 60 in which the optical connected 70 is loaded on the adapter 64 is positioned for each of the four posts 50 to be fixed thereto, the cable holder 3 projects upwardly from the back of the box 3 at the center of the base 10. Moreover, a power source switch 4, an emergency stop switch 5 and a touch panel 100 are provided in the front plane of the box 2. In the touch panel 100, the operator performs various setting operations necessary for the handling of the optical fiber end face polishing machine 1 by use of various screens thereof. The touch panel 100 informs states of polishing step execution by the optical fiber end face polishing machine 1 to the operator and requisite items such as states and records of each portion of the optical fiber end face polishing machine 1. Therefore, a control device 80 is provided inside the box 2.

Figure 9:
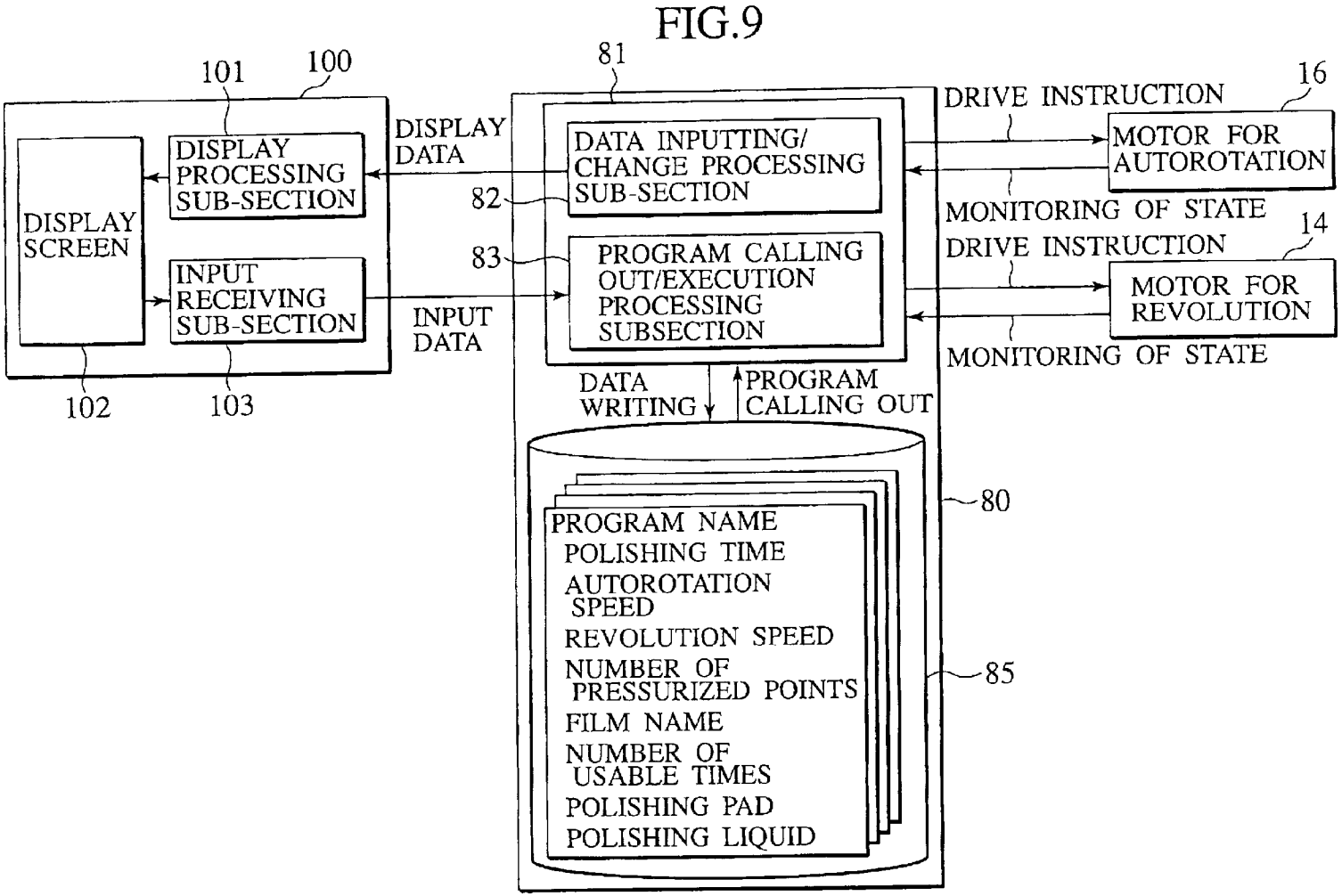
FIG. 9 is a block diagram relating to a control device.

FIG. 9 is a block diagram relating to the control device 80. The control device 80 is constituted by a processing section 81 and a memory 85. The processing section 81 comprises a data input/change processing sub-section 82 and a program calling/execution processing sub-section 83. On the other hand, the memory 85 stores programs for setting processing conditions of various polishing steps, and stores data as to items including program names, polishing times, autorotation speeds, revolution speeds, the number of pressurized points, film names, the limited number of usable times, polishing pads, and polishing liquid.

The processing section 81 outputs display data to a display processing section 101 of the touch panel 100, and receives data input from an input receiving section 103 of the touch panel 100, the data being input by the operator who observes a display screen 102 of the touch panel 100. The processing section 81 writes the input data to the memory 85 upon receipt of the input data, and calls out the program from the memory 85 to allow the display screen 102 of the touch panel 100 to display the foregoing items thereon. Moreover, the processing section 81 issues driving instructions to the revolution motor 16 and the autorotation motor 16 to allow them to operate in accordance with the program called out. At the same time, the processing section 81 monitors the operation states of the revolution and autorotation motors 14 and 16.

Therefore, as for several general kinds of polishing steps among various polishing steps by the optical fiber end face polishing machine 1, it is possible for the apparatus maker to previously set predetermined programs on its memory 85 and to ship the control device 80. Also, it is possible for the apparatus user to previously set desired program on its memory 85 and to execute an arbitrary program only by calling out it by use of the touch panel 100. Herein, as the program set by on the apparatus user side, know-how such as processing conditions accumulated by skillful operators can be programmed. Therefore, as long as the polishing steps are executed in accordance with the instructions of the programs which were once set, not only skillful operators but also ordinary operators can execute the polishing operations without any trouble.

Next, operations of the optical fiber end face polishing machine according to the above described embodiment will be described based on a manipulation method of the touch panel 100.

Figure 10:
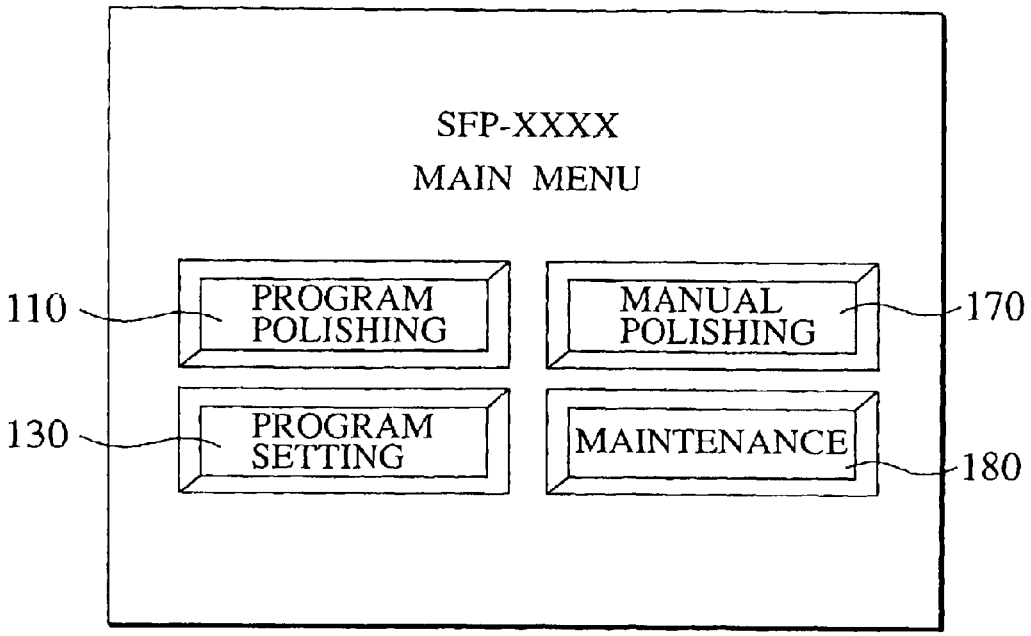
FIG. 10 is a diagram illustrating a main menu screen of a touch panel.

When the power source switch 4 is turned on, the main menu screen as shown in FIG. 10 is displayed on the touch panel 100. The main menu is constituted by four kinds of functions including (1) program polishing, (2) program setting, (3) manual polishing, and (4) maintenance, and a "program polishing" button 110, a "program setting" button 130, a "manual polishing" button 170, and a "maintenance" button 180, which respectively select corresponding functions, are displayed.

(Program Polishing)

Figure 11:
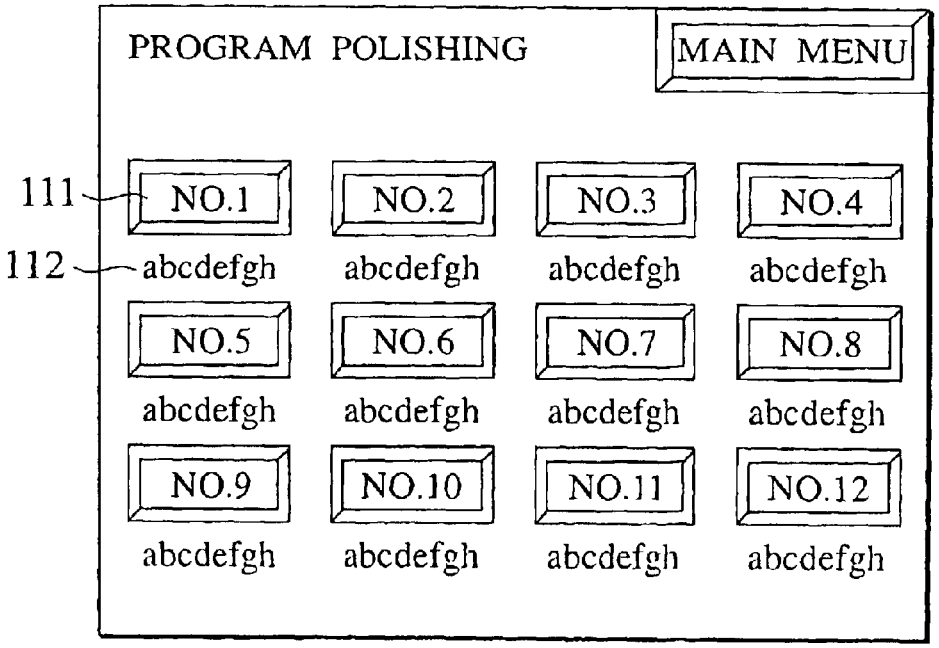
FIG. 11 is a diagram illustrating a program list screen of the touch panel.

In the program polishing, the polishing operation is carried out according to the steps previously programmed. When the "program polishing" button 110 is pushed selectively from the main menu of FIG. 10, the displaying is switched to the program list screen of FIG. 11. On this program list screen, twelve program selection buttons 111 (shown by No. 1 to No. 12) and program names 112 (shown by "abcdefgh") respectively corresponding to the selection buttons 111 are displayed in addition to the "main menu" button.

Figure 12:
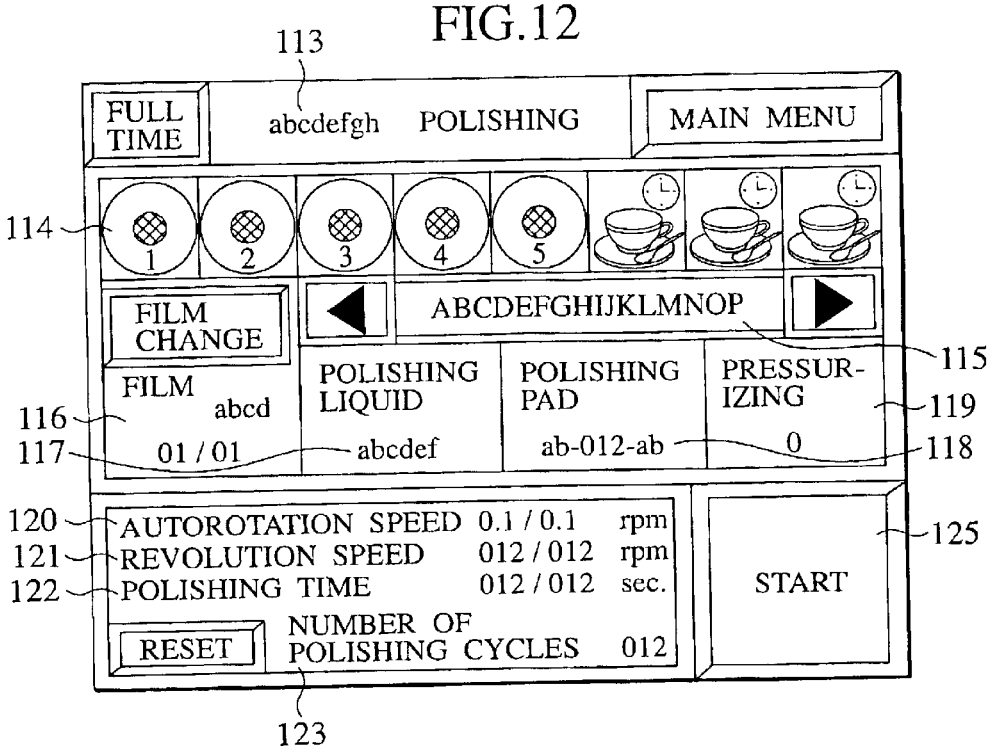
FIG. 12 is a diagram illustrating a program step screen of the touch panel.

When a target program is selected among No. 1 to No. 12 and a program selection button 111 corresponding to the selected program is pushed, the displaying is switched to the program step screen of FIG. 12. On this program step screen, eight step number marks 114 and execution step numbers 115 (shown by "ABCDEFGHIJKLMNOP") expressing which step among the polishing steps is being executed are displayed in addition to the program names 113 (shown by "abcdefgh"). In this embodiment, since the step number marks 114 are eight in total, it is possible to set the polishing programs up to eight steps. Among the eight steps that can be set, in the example of FIG. 12, the screen shows that the polishing programs corresponding to five steps are set, and shows that the polishing steps are set for "1" to "5" among the step number marks 114, "1" to "5" being displayed by lamps (the lamps are not lighted because the polishing steps are not executed yet). Furthermore, the screen shows that the polishing steps are not set for "6" to "8" (not shown in FIG. 12) among the step number marks 114 by the marks expressing "coffee brake".

Furthermore, in the program step screen, the limited number of film usable times 116 (shown by films "abcd"), the polishing liquid 117 (shown by "abcdef"), the polishing pad 118 (shown by ab-012-ab"), the number of pressurizing points 119, the autorotation speed 120, the revolution speed 121, the polishing time 122, and the number of polishing cycles 123 are displayed. Among these, the numerical values for the limited number of film usable times 116, the autorotation speed 120, the revolution speed 121 and the polishing time 122 are displayed by present values and setting values.

Figure 13:
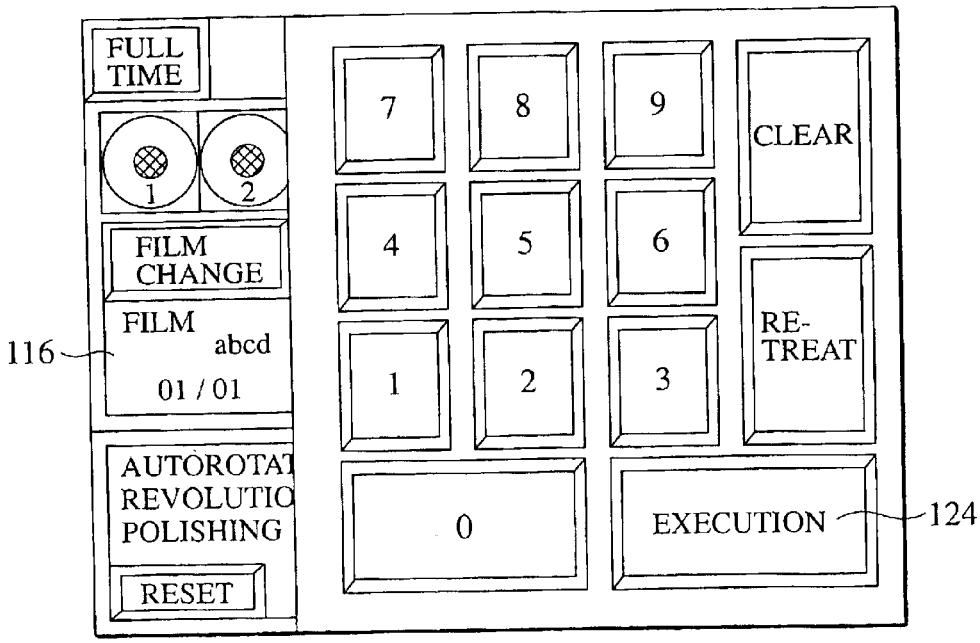
FIG. 13 is a diagram illustrating a screen of the touch panel used together with a 10-key keyboard.

In the case where a polishing film used is not a new article in starting the polishing step, upon pushing the displaying portion for the limited number of film usable times 116, the ten-key of FIG. 13 is displayed. Thereafter, the number of use until the last use of the polishing film is input. When the "execution" button 124 is pushed, the displaying returns to the program step screen of FIG. 12.

Figure 14:
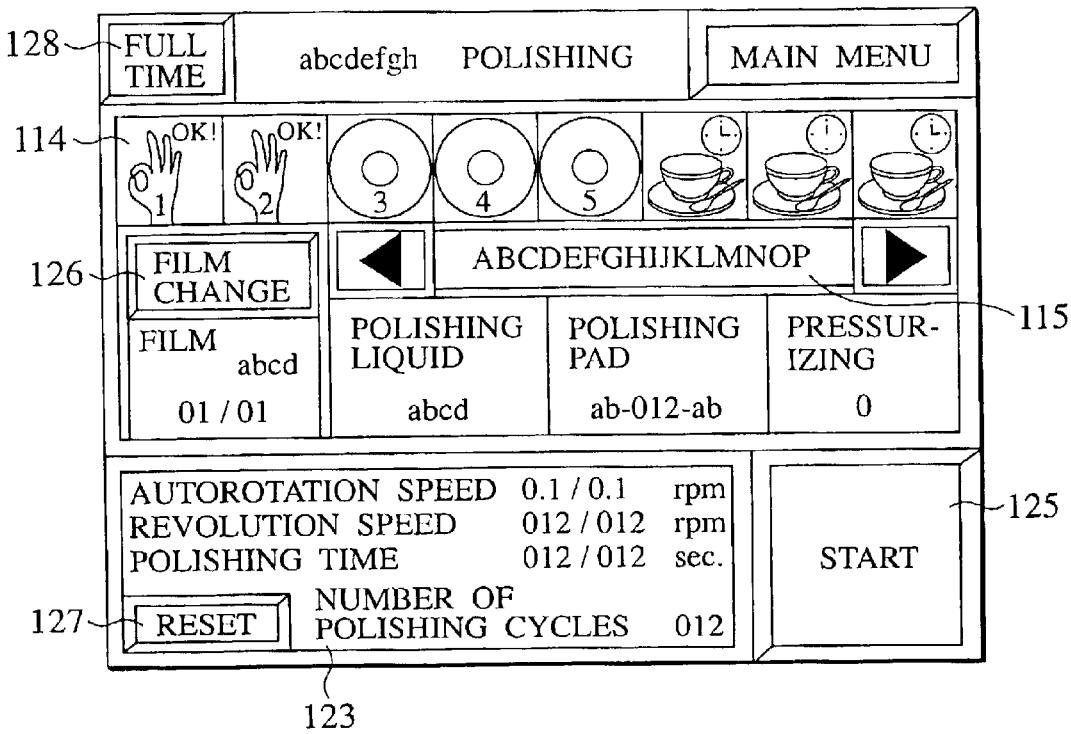
FIG. 14 is a diagram illustrating a program step screen of the touch panel.

When the "start" button 125 is pushed, the polishing starts from the first step, and during the first polishing step, the lamp of "1" among the step number marks 114 is lighted and the execution step number 115 displays that the first polishing step is being executed. For example, during the third polishing step, the lamp of "3" among the step number marks 114 is lighted as shown in FIG. 14, and "OK" mark is displayed for the lamps of "1" and "2" because the steps corresponding to the lamps of "1" and "2" has been already finished. During the third polishing step, the touch panel 100 is kept at a disable state that any operation is not accepted. When the third polishing step is completed, the displaying is switched to the program step screen for displaying the subsequent polishing step.

When the polishing film is used up to the limited number of film usable times, the "film replacement" button 126 flashes. In this case, after the polishing film is replaced with the new one, the "film replacement" button 126 is pushed. During flashing of the "film replacement" button 126, the polishing operation is not started even if the "start" button 125 is pushed.

When the "stawl" button 125 is pushed once more after all of the polishing steps has been completed, the polishing procedure returns to the first polishing step. At this time, the display number for the number of polishing cycles increases one by one. Note that the "reset" button 127 is pushed, the display number for the number of polishing cycles 123 returns to "1".

The "FULLTIME/HALFTIME switching" button 128 is switched depending on the number of ferrules to be polished. For example, the number of ferrule to be polished is equal to half of the number of polishing holders or less, the "FULLTIME/HALFTIME" button 128 is switched to "HALFTIME". Thus, the polishing time is halved.

(Program Setting)

Figure 15:
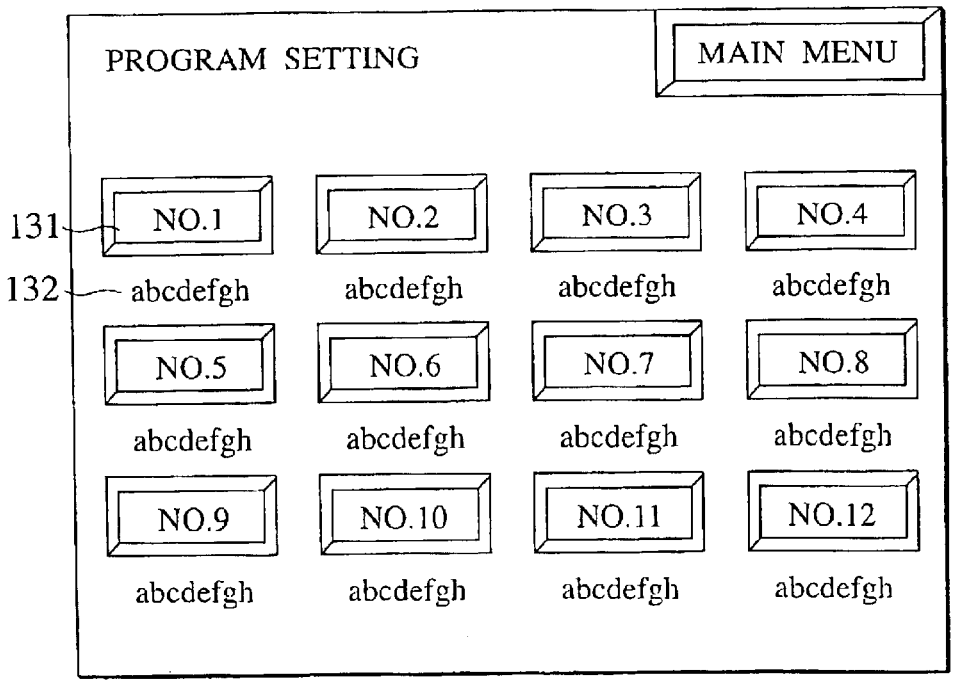
FIG. 15 is a diagram illustrating a program list screen of the touch panel.

The program setting is for newly preparing polishing procedures for the program polishing and changing of the number of steps of the polishing procedures. When the "program setting" button 130 is pushed in the main menu of FIG. 10, the displaying is switched to the program list screen of FIG. 15. On this program list screen, the twelve program selection buttons 131 (shown by No. 1 to No. 12), and the program names 132 (shown by "abcdefgh") corresponding to these buttons 131 are displayed in addition to the "main menu" button.

Figure 16:
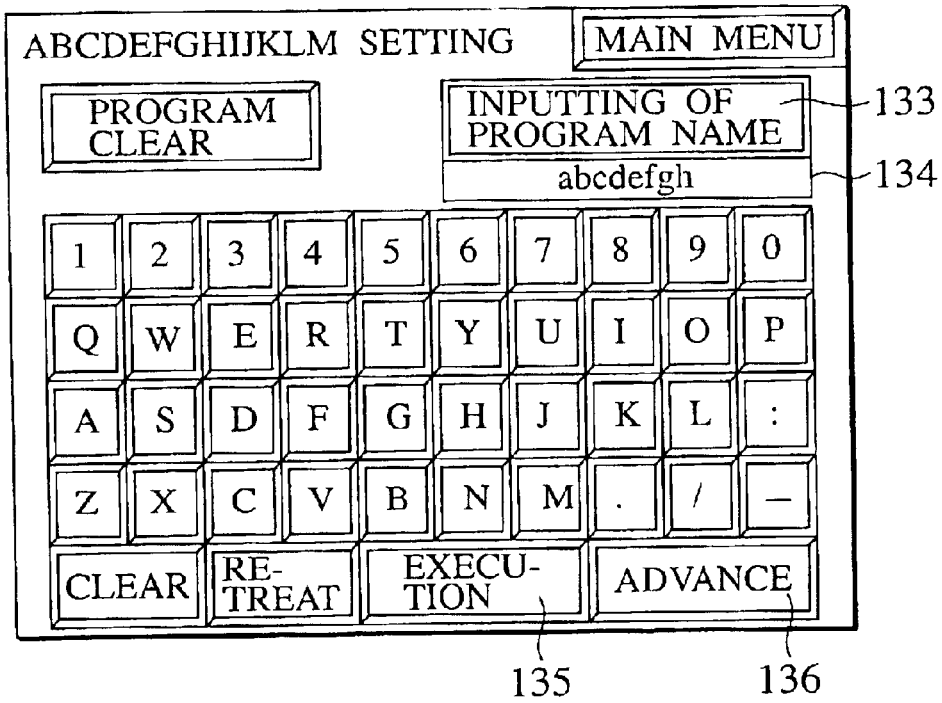
FIG. 16 is a diagram illustrating a program name inputting screen of the touch panel.

When numbers to be newly selected among the program selection buttons 131 (shown by No. 1 to No. 12) or programs desired to be changed are selected among the program list including the program selection buttons 131 (shown by No. 1 to No. 12), and when the program selection button 131 corresponding to the program is pushed, the displaying is switched to the program name input screen of FIG. 16.

When the polishing procedures for the program polishing are newly prepared and the program names are changed, the "program name input" button 133 is pushed, the display section of the program name 134 (shown by "abcdefgh") flashes. Subsequently, the program name that can be input up to eight characters) is input, and then the "execution" button 135 is pushed, thus confirming the program name. Thereafter, the screen advances to the next screen by pushing the "advance" button 136. Moreover, when the program name needs not to be changed, upon pushing of the "advance" button 136, the screen can advance to the next screen without changing the program name previously input.

Figure 17:
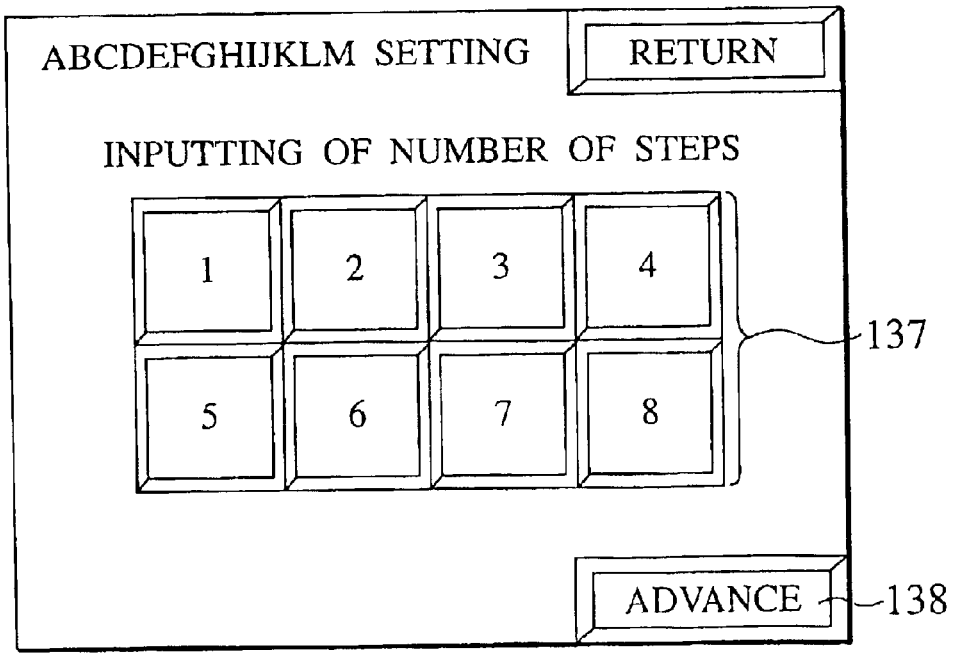
FIG. 17 is a diagram illustrating a screen of the touch panel on which the number of steps is input.

When the "advance" button 136 is pushed on the program name input screen of FIG. 16, the displaying is switched to the step number input screen of FIG. 17.

When the polishing procedures for the program polishing are newly prepared and the number of steps of the polishing procedures is changed, the step number button 137 for the necessary number of steps is selectively pushed among the buttons "1" to "8", and then the "advance" button 138 is pushed. Thus, the displaying advances to the next screen. Furthermore, when the number of steps is not changed, the "advance" button 138 is pushed without pushing the step number button 137, and the displaying advances to the next screen.

Figure 18:
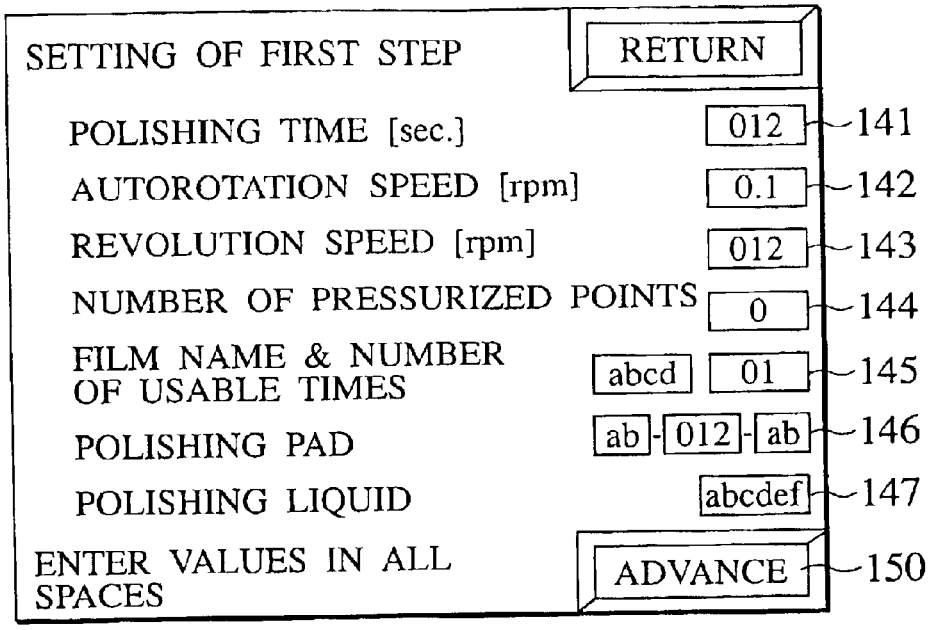
FIG. 18 is a diagram illustrating a step setting screen of the touch panel.

When the "advance" button 138 is pushed on the step number input screen of FIG. 17, the displaying is switched to the step setting screen of FIG. 18. On this step setting screen, the program change buttons 141 to 147 that can set the items including the polishing time 141, the autorotation speed 142, the revolution speed 143, the number of pressurized points 144, the film name & limited number of usable times 145, the polishing pad 146 and the polishing liquid 147 can be displayed.

Figure 19:
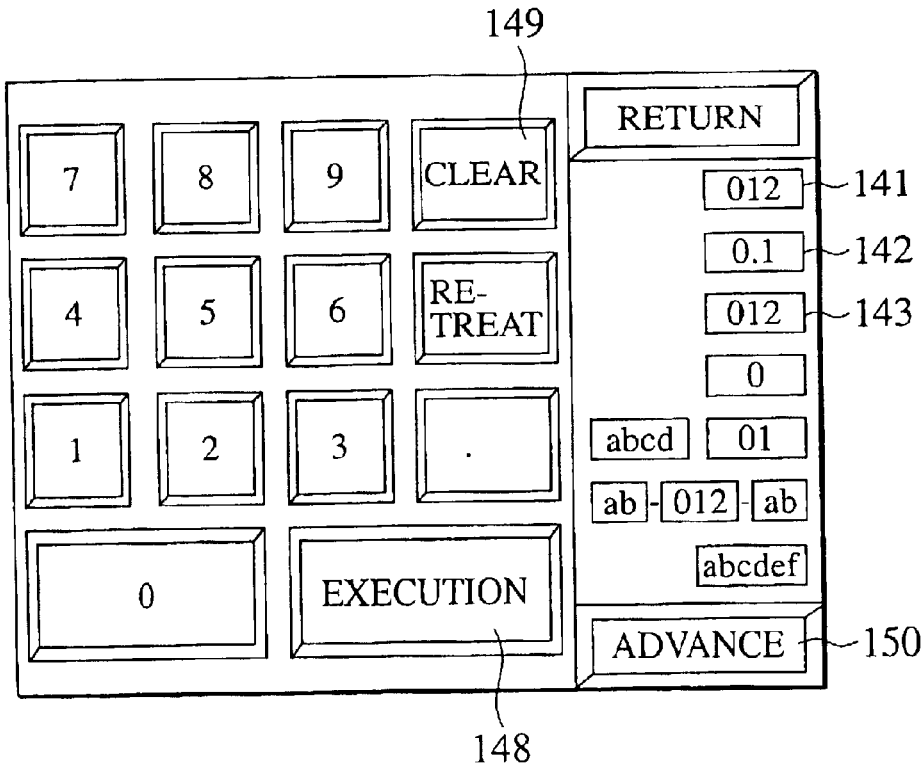
FIG. 19 is a diagram illustrating the touch panel used together with a 10-key keyboard.
Figure 20:
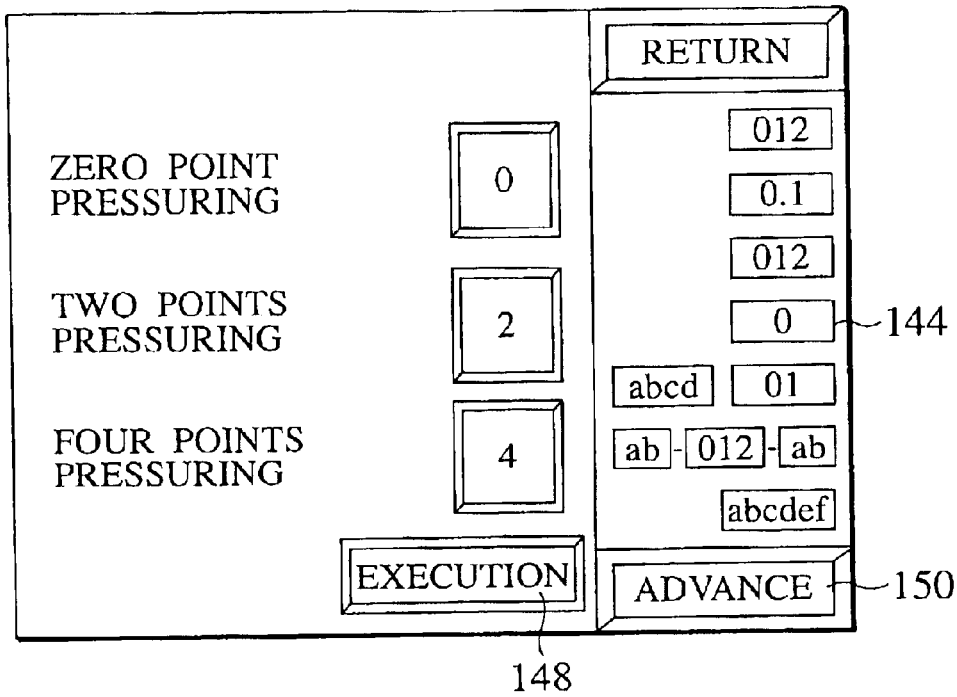
FIG. 20 is a diagram illustrating a screen of the touch panel used together with pressurized point setting keys.
Figure 21:
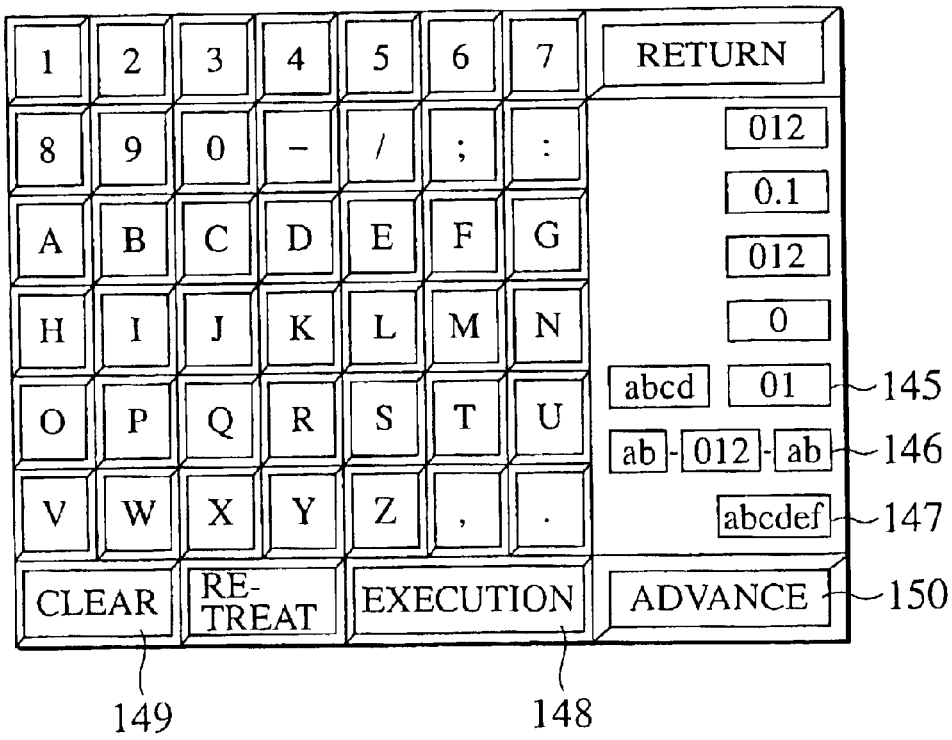
FIG. 21 is a diagram illustrating a screen of the touch panel used together with character keys.

When the polishing procedures for the program polishing are newly prepared and the program is changed, any of the program change button 141 to 147 corresponding to the item desired to be changed is pushed. Thus, any of the ten-key of FIG. 19, the pressurized point setting key (only "0", "2" and "4") and the character key of FIG. 21 is displayed. Accordingly, when the "execution" button 148 is pushed after inputting a necessary value, the display value of the pushed program change button is changed, and the displaying returns to the step setting screen of FIG. 18.

Values that can be inputted in each program include the polishing time of 1 to 999 [sec], the autorotation speed: 0.1 to 2.0 [rpm], the revolution speed: 5 to 150 [rpm], the number of pressurized points: 0, 2 and 4 [points], the film name & limited number of usable times: four characters or less-1 to 99, the polishing pad: two characters or less-0 to 99-two characters or less, and the polishing liquid: six characters or less.

When items different from items desired to be input were designated erroneously, if the foregoing values were not input, the "execution" button 148 is pushed. Thus, the displaying can return to the step setting screen without changing the values. Moreover, if the foregoing values were input, the "clear" button 149 is pushed, and then the "execution" button 148 is pushed. Thus, the displaying can return to the step setting screen without changing the foregoing values.

When inputting of the necessary values for all items are completed, the "advance" button 150 is pushed, and the polishing procedure advances to the next step. For example, the polishing procedure advances from the first step setting to the second step setting. Then, when necessary step settings for all of the step numbers that have been set on the step number input screen of FIG. 17, the "advance" button 150 is pushed. Thus, the displaying is switched to the confirmation screen of FIG. 22. On the confirmation screen, there are the three screens of FIGS. 22, 23 and 24, and these three screens are sequentially displayed.

Figure 22:
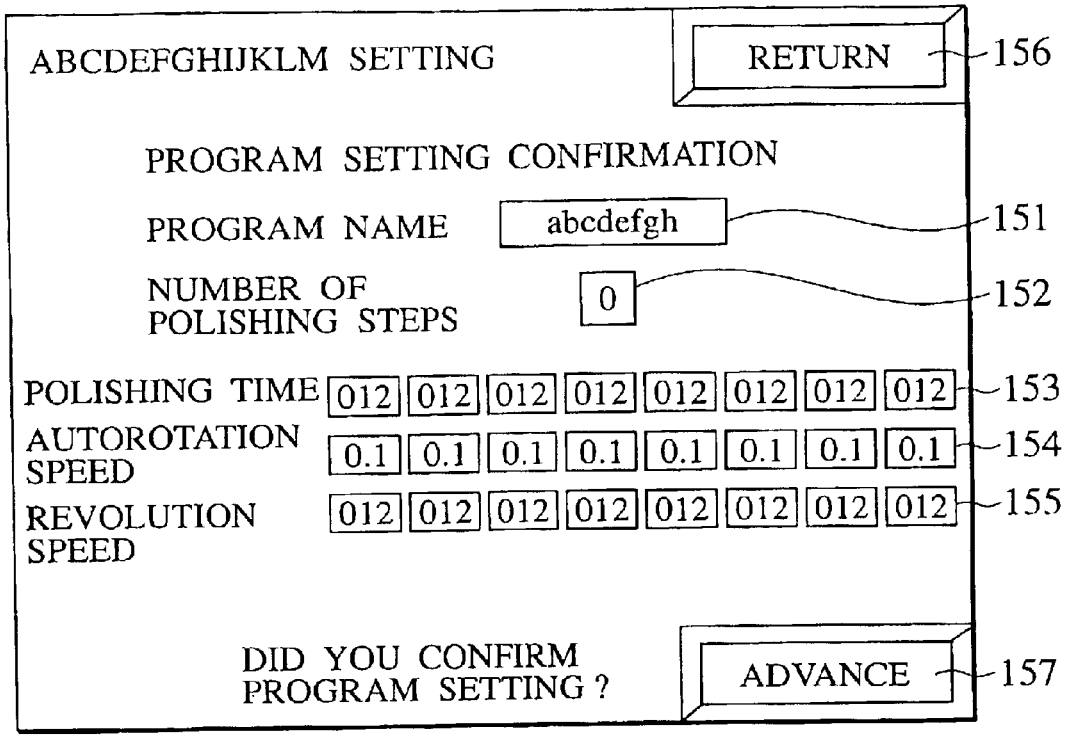
FIG. 22 is a diagram illustrating a confirmation screen of the touch panel.

First, on the confirmation screen of FIG. 22, the program name 151 (shown by "abcdefgh"), the number of steps 152, the polishing time 153, the autorotation speed 154 and the revolution speed 155 are confirmed. As to unused steps and items which are not input, the displaying is performed by use of "0" or nothing is displayed for them. When something to be changed because of erroneous inputting is found, the "return" button 156 is repeatedly pushed, and the displaying returns to a screen on which the changing for the erroneous inputting must be conducted. Thus, the erroneous inputting is changed. If there is no problem, the "advance" button 157 is pushed, and the displaying advances to the next screen.

Figure 23:
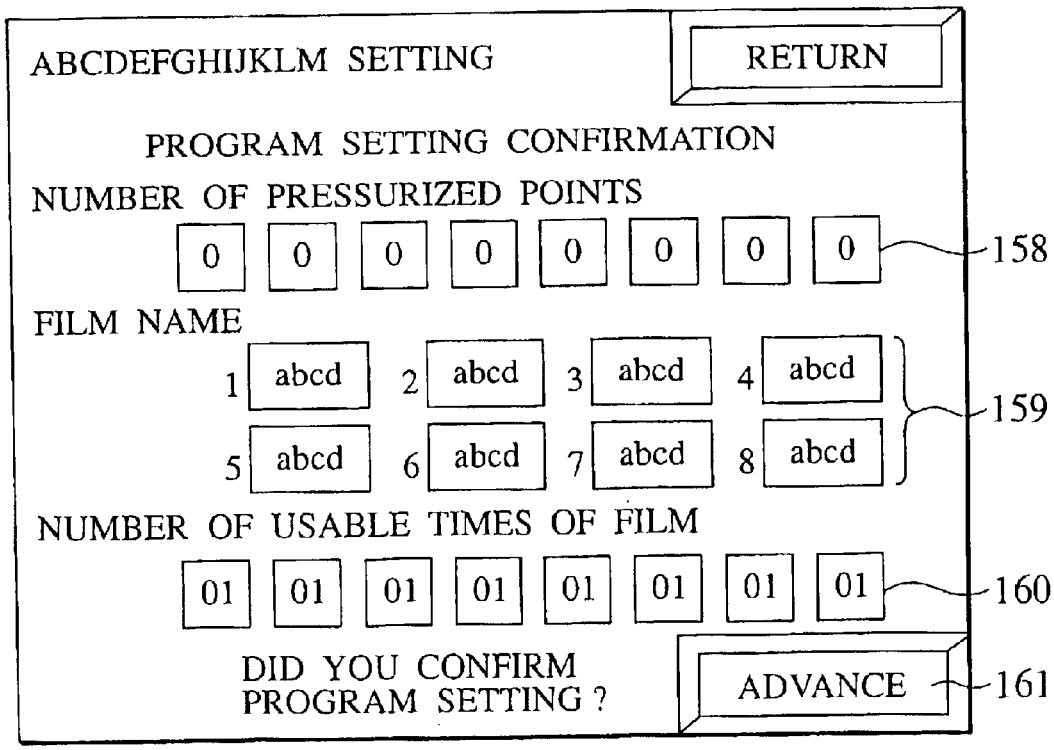
FIG. 23 is a diagram illustrating a confirmation screen of the touch panel.

On the confirmation screen of FIG. 23, the number of pressurized points 158, the film name 159 (shown by "abcd") and the limited number of film usable times 160 are confirmed. If there is no problem, the "advance" button 161 is pushed, and the displaying advances to the next screen.

Figure 24:
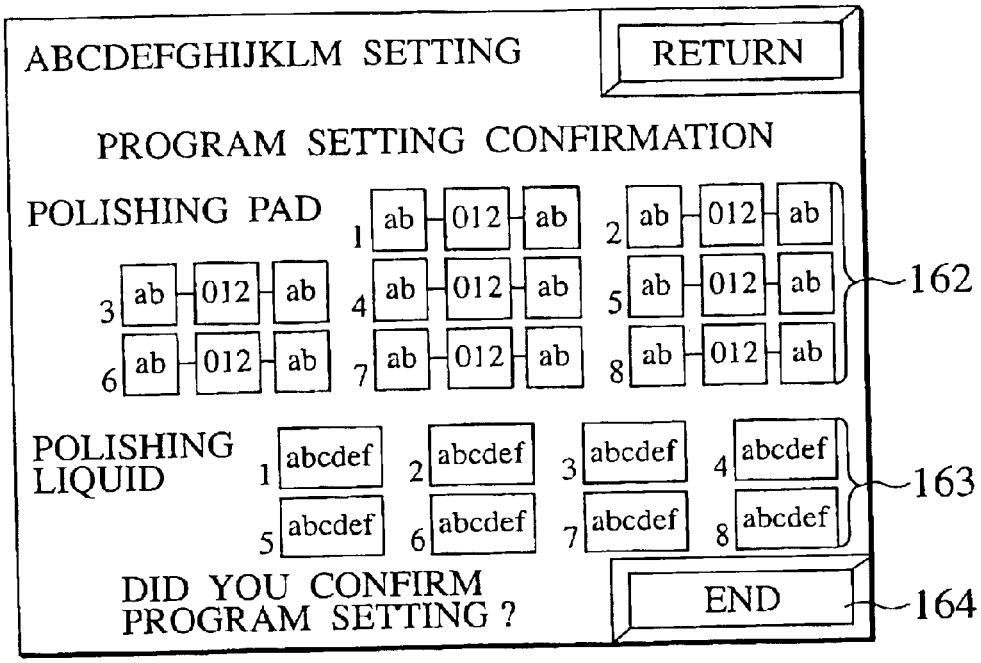
FIG. 24 is a diagram illustrating a confirmation screen of the touch panel.

On the confirmation screen of FIG. 24, the polishing pad 162 (shown by "ab-012-ab") and the polishing liquid 163 are confirmed. If there is no problem, the "completion" button 164 is pushed, and the program setting is completed.

(Manual Polishing)

Figure 25:
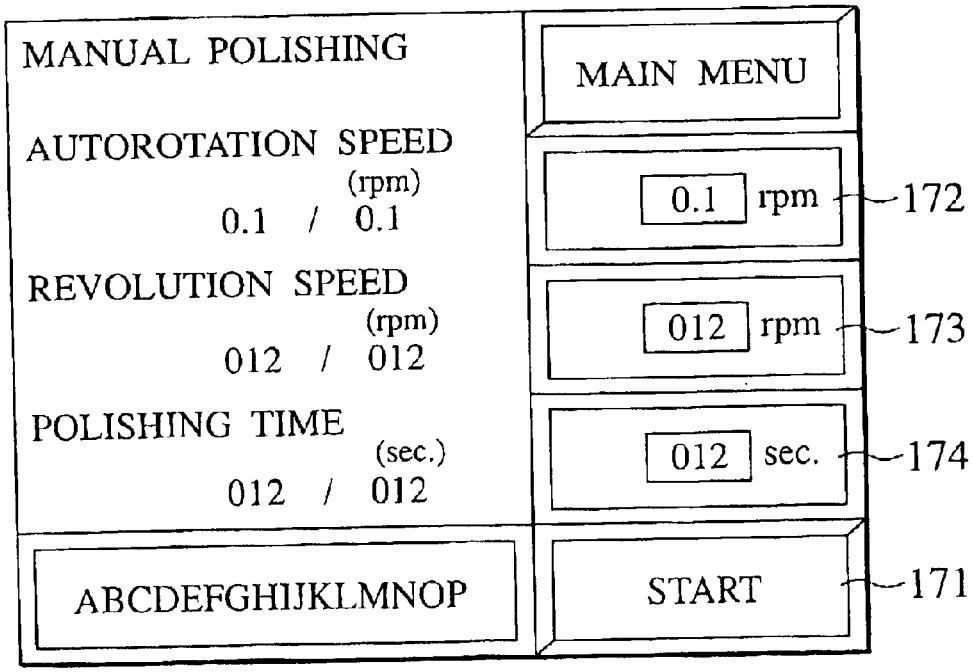
FIG. 25 is a diagram illustrating a manually polishing screen of the touch panel.

The manual polishing can be performed by setting only three items including the autorotation speed, the revolution speed and the polishing speed. When the "manual polishing" button 170 is pushed selectively among the buttons of the main menu of FIG. 10, the polishing procedure is switched to the manual polishing screen of FIG. 25.

When the "start" button 171 is pushed, the polishing starts in a state where the values that were set are held, and during the manual polishing, the touch panel 100 is kept at a disable state that any operation is not accepted.

Figure 26:
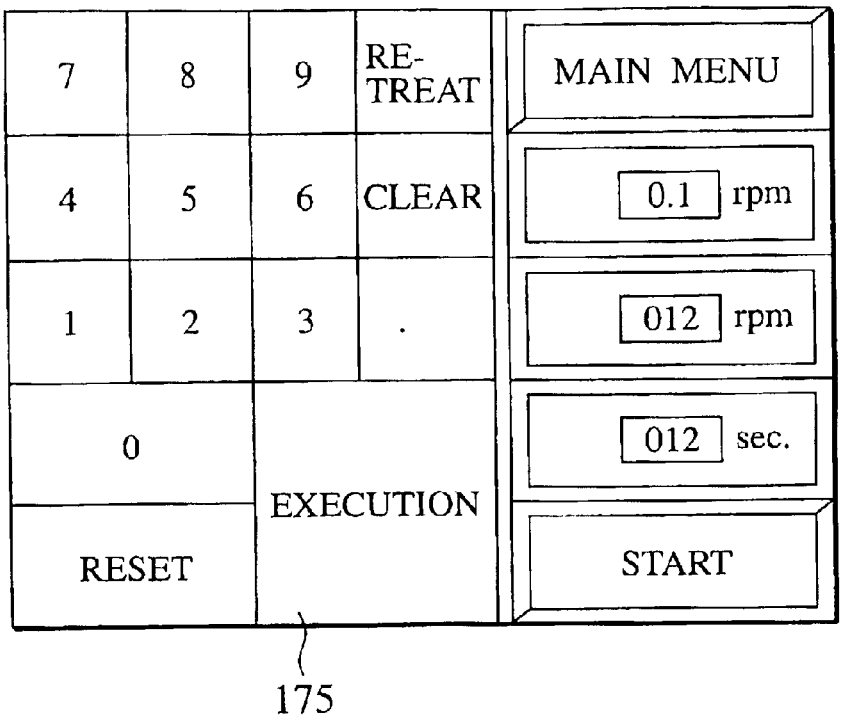
FIG. 26 is a diagram illustrating the touch panel used together with a 10-key keyboard.

When at least one of the numeric value changing buttons 172 to 174 respectively corresponding to the three items including the autorotation speed 172, the revolution speed 173 and the polishing time 174 is pushed in changing the numeric values, the ten-key of FIG. 26 is displayed. Accordingly, when the numeric values desired to be input are input and the "execution" button 175 is pushed, the numeric values are changed, and the displaying returns to the manual polishing screen.

(Maintenance)

In the maintenance, the total polishing time, the polishing time, the total operation time, the operation time and the elapsed time after the last maintenance are displayed, and the operator can watch them. When the "maintenance" button 180 is pushed in the main menu of FIG. 10, the displaying is switched to the maintenance selection screen of FIG. 27.

Figure 27:
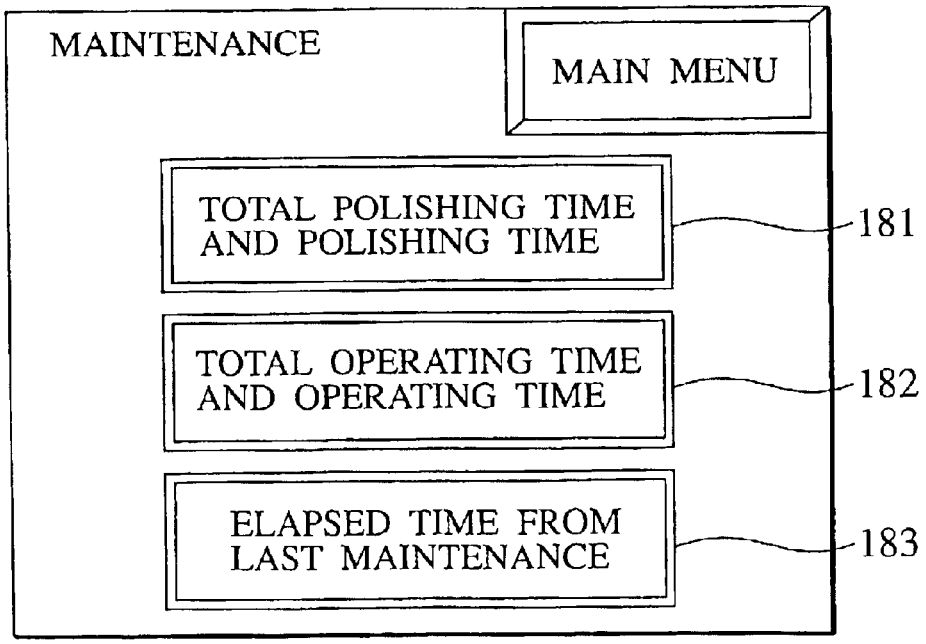
FIG. 27 is a diagram illustrating a maintenance selection screen of the touch panel.
Figure 28:
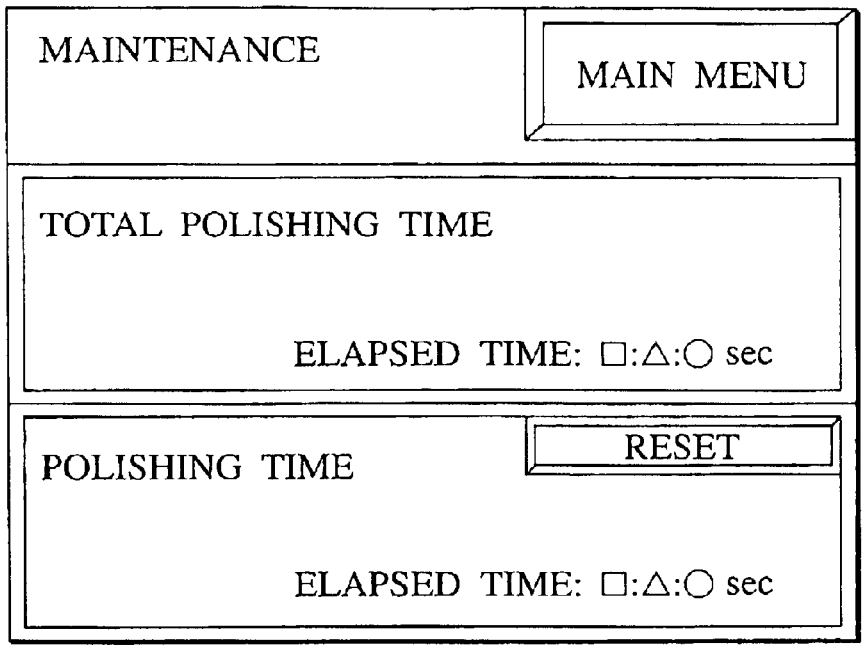
FIG. 28 is a diagram illustrating of a screen of the touch panel displaying a total polishing time/polishing time.
Figure 29:
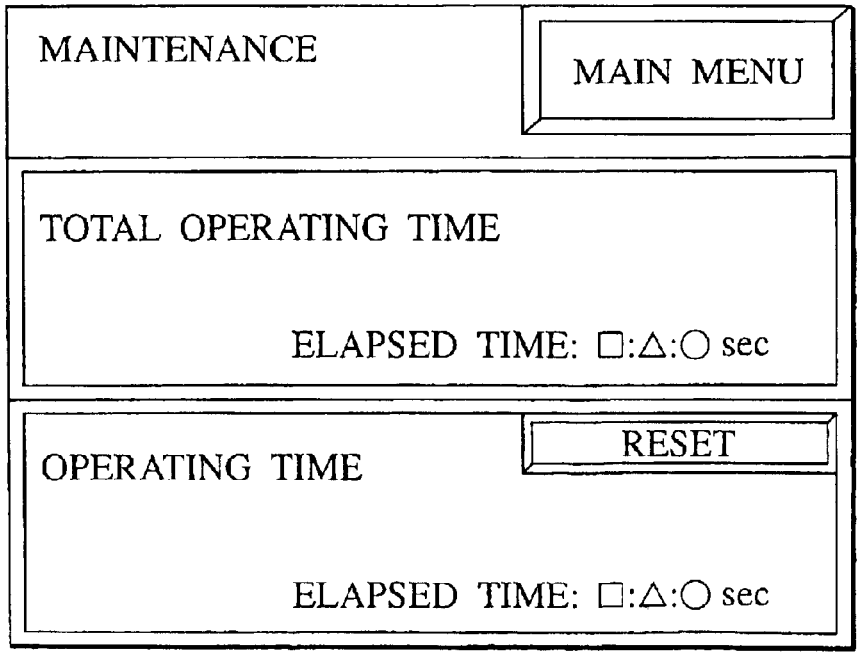
FIG. 29 is a diagram illustrating of a screen of the touch panel displaying a total operating time/operating time.

On the maintenance selection screen of FIG. 27, when the "total polishing time and polishing time" button 181 is pushed, the displaying is switched to the total polishing time/polishing time display screen of FIG. 28. Moreover, when the "total operation time and operation time" button 182 is pushed, the displaying is switched to the total operation time/operation time display screen of FIG. 29. Moreover, when the "elapsed time after the last maintenance" button 183 is pushed, the displaying is switched to the elapsed time selection time of FIG. 30.

Figure 30:
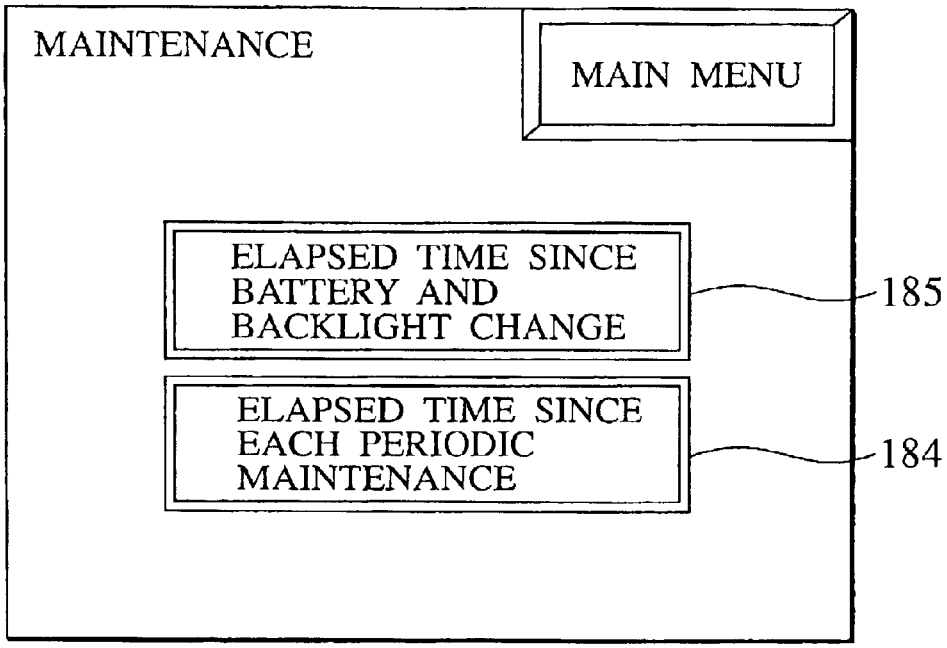
FIG. 30 is a diagram illustrating a select screen of the touch panel displaying a elapsed time.
Figure 31:
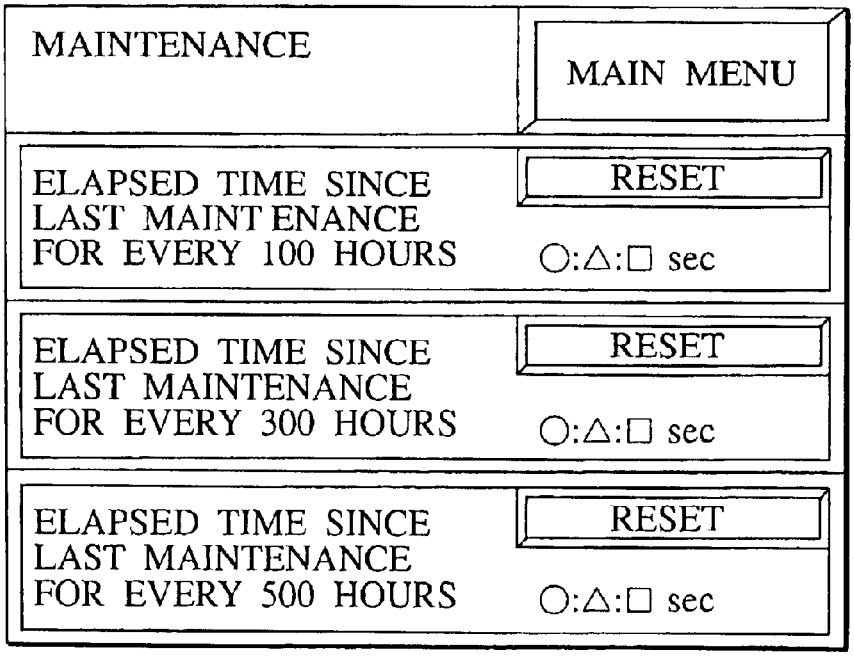
FIG. 31 is a diagram illustrating a screen of the touch panel displaying elapsed times since 100 hour maintenance, 300 hour maintenance and 500 hour maintenance.
Figure 32:
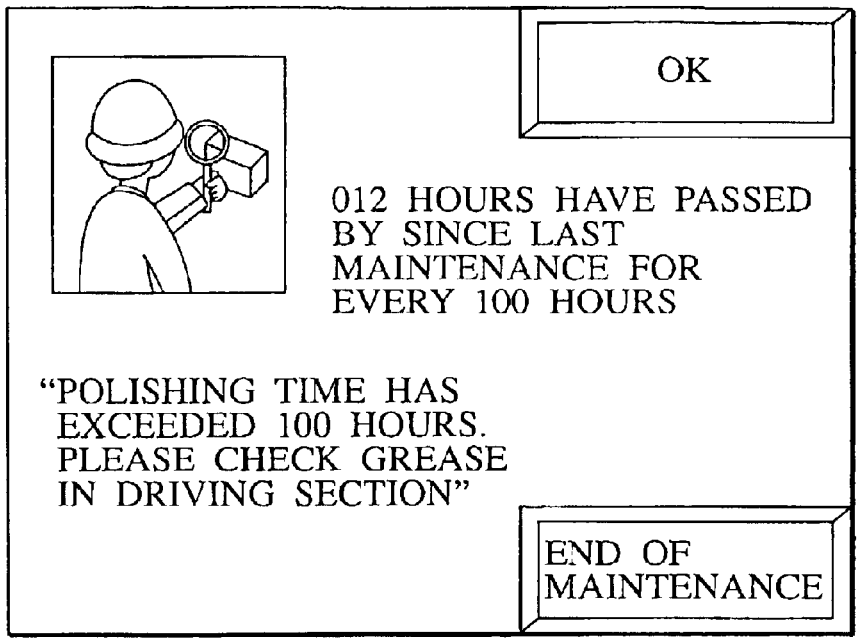
FIG. 32 is a diagram illustrating a screen of the touch panel after passage of 100 hours.
Figure 33:
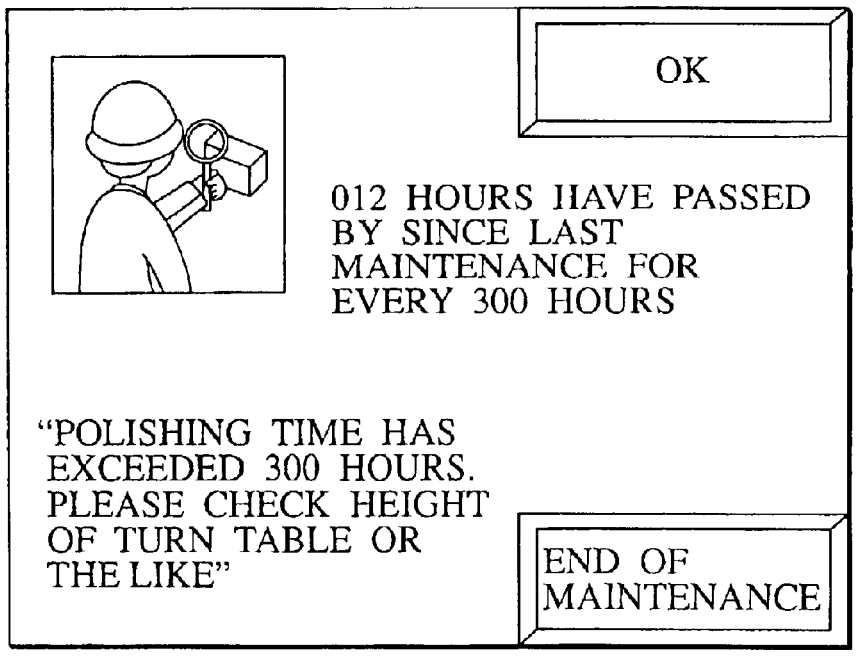
FIG. 33 is a diagram illustrating a screen of the touch panel after passage of 300 hours.
Figure 34:
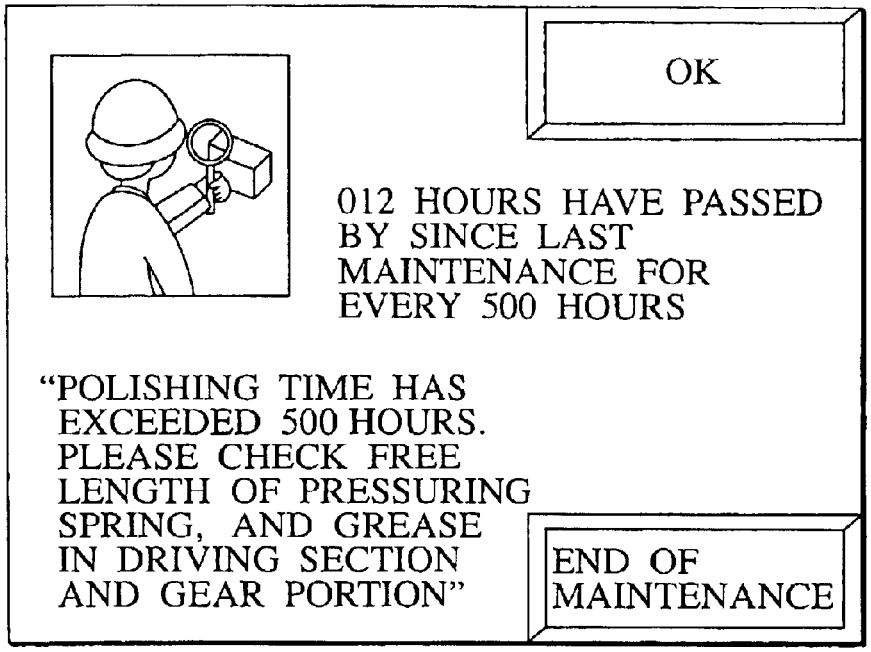
FIG. 34 is a diagram illustrating a screen of the touch panel after passage of 500 hours.

On the elapsed time selection screen of FIG. 30, when the "elapsed time after each periodic maintenance" button 184 is pushed, the displaying is switched to the screen from the elapsed time from 100 hours/300 hours/500 hours shown in FIG. 31. Then, when the polishing time of 100 hours has elapsed, the displaying is switched to the 100 hour-exceeded screen of FIG. 32. Moreover, when the polishing time of 300 hours has elapsed, the displaying is switched to the 300 hour-exceeded screen of FIG. 33. Sill furthermore, when the polishing time of 500 hours has elapsed, the displaying is switched to the 500 hour-exceeded screen of FIG. 34. At this time, the message in accordance with the over time (spots of the maintenance and the like) is also displayed (see FIGS. 32, 33 and 34).

Figure 35:
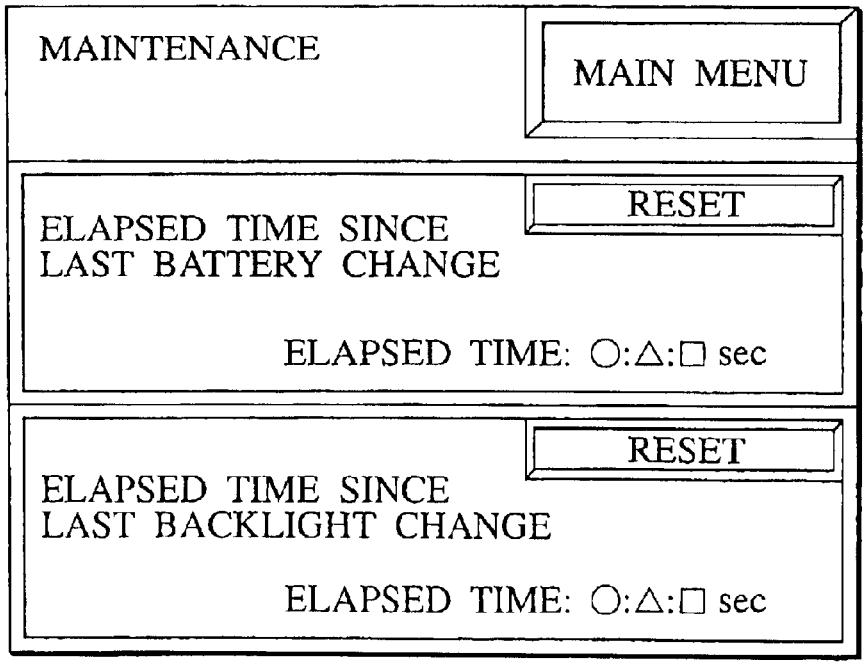
FIG. 35 is a diagram illustrating a screen of the touch panel displaying elapsed times since battery/backlight exchanges.
Figure 36:
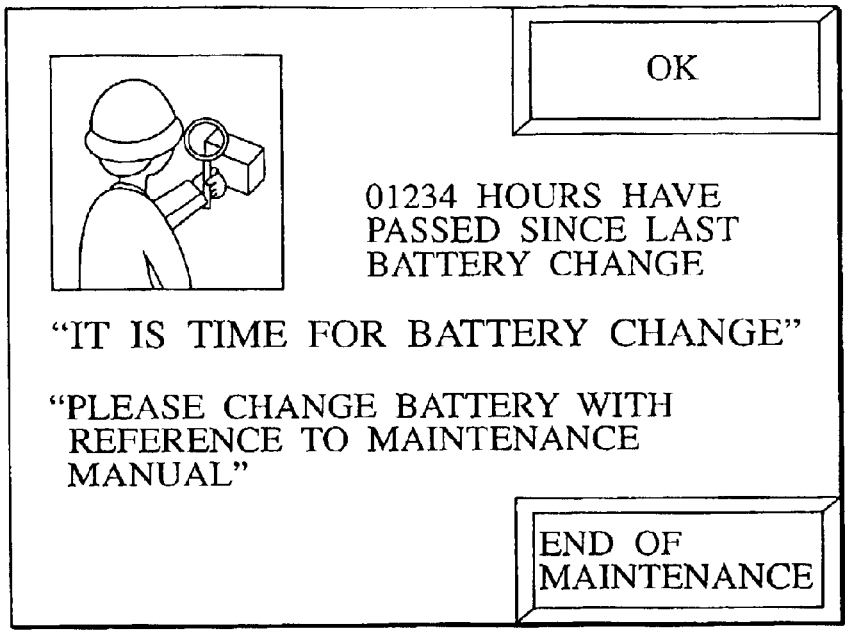
FIG. 36 is a diagram illustrating a screen of the touch panel displaying coming of a battery replacement time.
Figure 37:
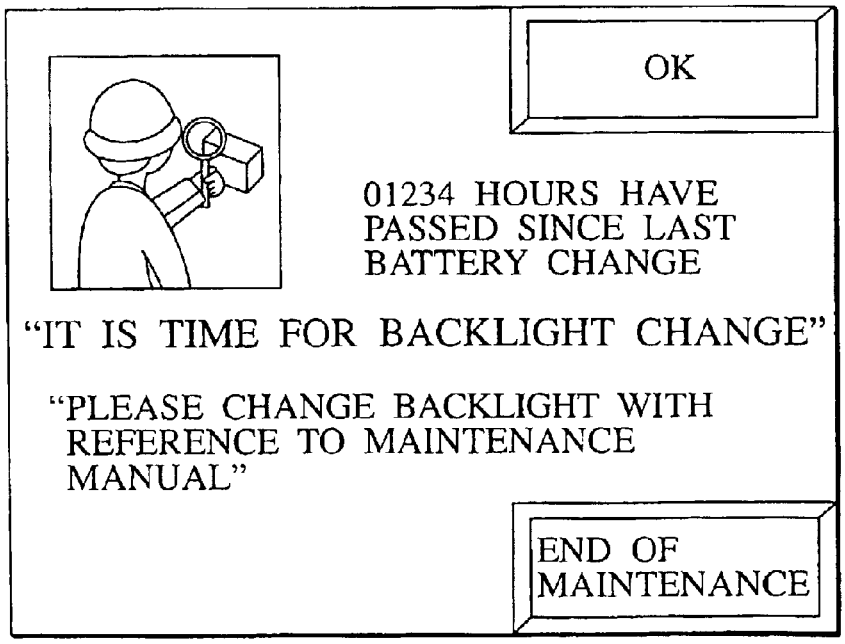
FIG. 37 is a diagram illustrating a screen of the touch panel displaying coming of a backlight replacement time.

On the elapsed time selection screen of FIG. 30, when the "elapsed time from battery/backlight replacement" button 185 is pushed, the displaying is switched to the display screen of elapsed time from battery/backlight replacement of FIG. 35. Then, when a predetermined period of time has elapsed from the last battery replacement, the displaying is switched to the battery replacement time coming screen of FIG. 36. Moreover, when a predetermined period of time has elapsed from the last backlight replacement, the displaying is switched to the backlight replacement time coming screen of FIG. 37.

What is claimed is:

1. An optical fiber end polishing machine, comprising:

a turntable moving its center along a circular orbit which has a smaller diameter than that of an autorotation disk and the center of which is a central axial line of the autorotation disk, thus revolving both around the central axial line and on it own axis in accordance with an autorotation of the autorotation disk;

a holding member for holding an optical fiber to be polished by a polishing film arranged on an upper plane of the turn table;

a control device for controlling an autorotation motor of the turntable and a revolution motor thereof; and a memory for storing a control program which allows the control device to execute predetermined polishing steps, wherein the control device calls out the control program and allows the autorotation motor and the revolution motor to operate in accordance with the control program.

2. An optical fiber end face polishing machine, comprising:

a turntable moving its center along a circular orbit which has a smaller diameter than that of an autorotation disk and the center of which is a central axial line of the autorotaton disk, thus revolving both around the central axial line and on it own axis in accordance with an autorotation of the autorotation disk;

a holding member for holding an optical fiber to be polished by a polishing film arranged on an upper plane of the turn table;

a control device for controlling an autorotation motor of the turntable and a revolution motor thereof;

a touch panel for operating the control device; and a memory for storing a plurality of control programs which allow the control device to execute predetermined polishing steps, wherein when an operator manipulates the touch panel to select a desired control program among the plurality of control programs stored in the memory, the control device calls out the selected control program and allows the autorotation motor and the revolution motor to operate in accordance with the selected control program.

3. The optical fiber end face polishing machine according to claim 2, wherein when the operates manipulates the touch panel to input data necessary for the control program, the control device stores the control program determined by the input data in the memory.

4. The optical fiber end face polishing machine according to claim 2, wherein during executions of the polishing steps, the control device allows the touch panel to display states of portions of the machine including operation states of the autorotation and revolution motors.

5. The optical fiber end face polishing machine according to claim 2, wherein the control device controls the polishing machine so that a polishing operation is not executed during the time when setting contents are being registered in the memory.

* * * * *